US010695731B2

(12) United States Patent
Macedo et al.

(10) Patent No.: US 10,695,731 B2
(45) Date of Patent: Jun. 30, 2020

(54) DYE DISPENSING SYSTEM

(71) Applicant: CLiCS, LLC, La Jolla, CA (US)

(72) Inventors: Leilani M. Macedo, Carlsbad, CA (US); Charles D. Brown, Carslbad, CA (US); Jeffrey F. Macedo, Sparks, NV (US); Stuart D'Alessandro, Sparks, NV (US); Christopher Munz, Reno, NV (US)

(73) Assignee: CliCS, LLC, La Jolla, CA (US)

( * ) Notice: Subject to any disclaimer, the term of this patent is extended or adjusted under 35 U.S.C. 154(b) by 0 days.

(21) Appl. No.: 16/351,208

(22) Filed: Mar. 12, 2019

(65) Prior Publication Data

US 2019/0308149 A1 Oct. 10, 2019

Related U.S. Application Data

(63) Continuation of application No. 15/643,814, filed on Jul. 7, 2017, now Pat. No. 10,232,330.

(Continued)

(51) Int. Cl.
*B01F 13/10* (2006.01)
*B01F 15/02* (2006.01)

(Continued)

(52) U.S. Cl.
CPC ..... *B01F 13/1058* (2013.01); *A45D 44/00* (2013.01); *B01F 13/1066* (2013.01);

(Continued)

(58) Field of Classification Search
CPC ..... B01F 13/1058; B01F 13/1066; B01F 13/1069; B01F 15/0237; B01F 15/0462; A45D 44/00

(Continued)

(56) References Cited

U.S. PATENT DOCUMENTS 5,078,302 A 1/1992 Hellenberg
6,067,504 A 5/2000 MacFarlane et al.

(Continued)

FOREIGN PATENT DOCUMENTS

CN 102556374 A 7/2012

OTHER PUBLICATIONS

Abraham, A Beginner's Guide to (CIE) Colorimetry, Medium, Sep. 10, 2016, Accessed Online: https://medium.com/hipster-color-science/a-beginners-guide-to-colorimetry-401f1830b65a.

(Continued)

*Primary Examiner* — Vishal Pancholi

(74) *Attorney, Agent, or Firm* — Knobbe, Martens, Olson & Bear, LLP

(57) ABSTRACT

An apparatus for dye dispensing is disclosed herein. The apparatus includes a controller and a tray. The tray communicates with the controller and is configured with at least one opening. At least one canister is configured with an identifier and a dye. The dye is associated with the identifier. A reader communicates with the controller. A dispenser comprises an actuator communicating with the controller and a lever arm. The lever arm is coupled to the actuator and configured with a projection. The reader, based on the identifier, identifies a selected dye in a selected canister associated with a dye formulation. When the selected canister is aligned with a dispensing area, the dispenser applies a downward force on the selected canister and dispenses the selected dye.

16 Claims, 19 Drawing Sheets

Related U.S. Application Data

(60) Provisional application No. 62/359,960, filed on Jul. 8, 2016.

(51) Int. Cl.
*B01F 15/04* (2006.01)
*A45D 44/00* (2006.01)
*A45D 19/00* (2006.01)

(52) U.S. Cl.
CPC ..... *B01F 13/1069* (2013.01); *B01F 15/0237* (2013.01); *B01F 15/0462* (2013.01); *A45D 2019/0066* (2013.01); *A45D 2200/058* (2013.01); *B01F 2215/005* (2013.01); *B01F 2215/0031* (2013.01)

(58) Field of Classification Search
USPC ..... 222/23, 53, 144
See application file for complete search history.

(56) References Cited

U.S. PATENT DOCUMENTS

| | | | |
|---|---|---|---|
| 6,089,408 | A | 7/2000 | Fox |
| 6,707,929 | B2 | 3/2004 | Marapane et al. |
| 7,185,789 | B2 | 3/2007 | Mink et al. |
| 7,591,861 | B2 | 9/2009 | Bolton et al. |
| 8,636,173 | B2 | 1/2014 | Bartholomew et al. |
| 8,897,915 | B2 | 11/2014 | Saranow |
| 8,977,389 | B2 | 3/2015 | Witchell et al. |
| 2009/0321470 | A1 | 12/2009 | Knoth |
| 2012/0018034 | A1 | 1/2012 | Bertoli et al. |
| 2012/0048880 | A1 | 3/2012 | Damolaris |
| 2014/0082854 | A1 | 3/2014 | Landa et al. |
| 2015/0089751 | A1 | 4/2015 | Landa et al. |
| 2016/0011051 | A1 | 1/2016 | Conti et al. |
| 2018/0080865 | A1 | 3/2018 | Godfrey et al. |

OTHER PUBLICATIONS

Brown et al, J. Soc. Cosmet. Chem., 36, pp. 31-37, Jan./Feb. 1985.
Kubelka and Munk, An Article on Optics of Paint Layers, Aug. 1931, 16 pages.
Park and Stearns, Spectrophotometric Formulation, Journal of the Optical Society of America, vol. 34, No. 2, Feb. 1944, 112-113.
Yang et al., On the Kubelka Munk Single-Constant/Two-Constant Theories, Textile Research Journal, Nov. 20, 2009, 10 pages, Online Access: http://trj.sagepub.com/cgi/content/abstract/80/3/263.
International Search Report and Written Opinion dated Oct. 16, 2017 for PCT Patent Application No. PCT/US2017/041050.

DYE DISPENSING SYSTEM

CROSS-REFERENCE TO RELATED APPLICATIONS

This application is a continuation of U.S. patent application Ser. No. 15/643,814, filed on Jul. 7, 2017 and entitled "Dye Dispensing System", now issued as U.S. Pat. No. 10,232,330, which claims priority to U.S. Provisional Patent Application No. 62/359,960, filed on Jul. 8, 2016 and entitled "Dye Dispensing System". Each of these documents is hereby incorporated by reference for all purposes in its entirety.

BACKGROUND

Hair coloring compositions are used for coloring human hair. Color service is a profitable area in the salon industry and can be a significant part of the cost structure of operating a salon. The components that are used to create hair coloring compositions are generally distributed separately in containers such as tubes or bottles and allow the stylist to create custom blends per client. Additionally, the components of the hair coloring composition are provided separately to prolong their useful life and avoid adverse chemical reactions that may occur if combined together.

There is a lot of waste in the salon industry with respect to color service. To create a custom hair coloring composition, the stylist utilizes small amounts of several different components such as colorant, coloring compound, dye or coloring chemicals from one or more containers. When a small amount of the component is used, the remainder of the component in the container may become waste because once the component is exposed to oxygen, such as when the container is opened, it may degrade in as little as a few days.

Not only is the remainder of the component in the container waste, but also the container itself along with its packaging. Moreover, some stylists lack the knowledge and skills required to select and mix the components to obtain the proper color formulation ratios for the custom hair color composition. These mistakes, mixture inaccuracies, inconsistencies and "do-overs" contribute to more waste.

SUMMARY

An apparatus for dye dispensing is disclosed herein. The apparatus includes a controller and a tray. The tray communicates with the controller and is configured with at least one opening. At least one canister is configured with an identifier and a dye. The dye is associated with the identifier. A reader communicates with the controller. A dispenser comprises an actuator communicating with the controller and a lever arm. The lever arm is coupled to the actuator and configured with a projection. The reader, based on the identifier, identifies a selected dye in a selected canister associated with a dye formulation. When the selected canister is aligned with a dispensing area, the dispenser applies a downward force on the selected canister and dispenses the selected dye.

DETAILED DESCRIPTION

Figure 1:
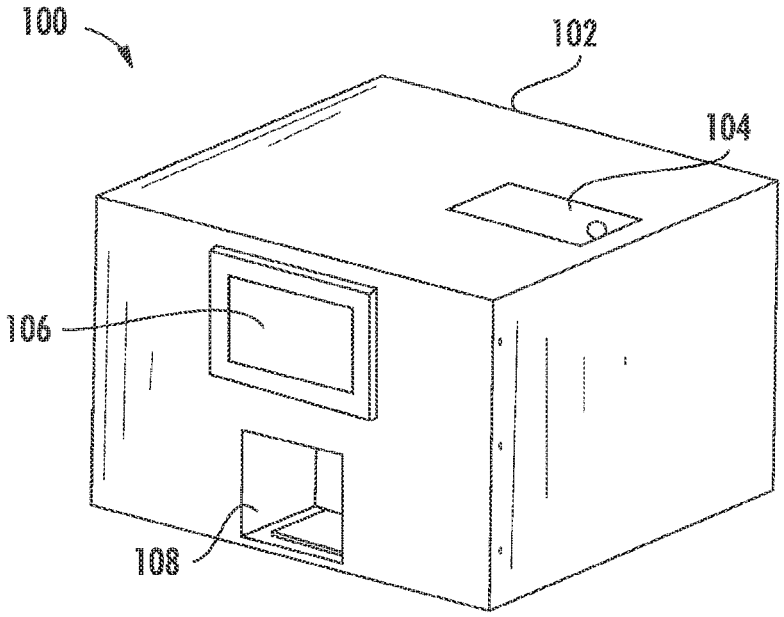
FIG. 1 is a perspective view of a dye dispensing apparatus in accordance with some embodiments.

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the scope thereof. For instance, features illustrated or described as part of one embodiment may be used with another embodiment to yield a still further embodiment. Thus, it is intended that the present subject matter covers all such modifications and variations within the scope of the appended claims and their equivalents.

The dye dispensing apparatus, system and method described herein dispenses dye for hair coloring with the ability to produce a relatively large number (e.g., approximately 4,000) unique color formulations, and a suite of optional treatments with computer controlled, precision dispensing. The unique color formulations may be created by master chemists and produced in large batches remotely, such as at a factory, then packaged in recyclable, refillable and reusable canisters. The dye dispensing apparatus, system and method may dispense the dye from the canister such as "base tones" or "base levels" which may comprise a large portion of the dispensed color formulation; "pure tones" or "tonal values" which are highly concentrated dyes of particular colors; and "developer" which may be different strengths of peroxide and bleach. Combining these ingredients produce unique color formulas. The dye in the canisters may consist of permanents, semi-permanents, demi-permanents, bleaches/lighteners, color refreshers, temporaries, toners or developers. In another embodiment, the developer is not provided in canisters or dispensed by the dye dispensing apparatus, but is supplied in a conventional container. The canisters are configured with an internal valve that enables approximately all of the dye in the canister to be dispensed without contamination. The system also includes the functionality of inventory management and communications.

The dye dispensing apparatus, system and method may monitor the individual canisters and transmit actual dispensed amounts to the network or central server (e.g., a cloud-based application, a standalone server device, etc.) which, in turn, may automate inventory management by initiating automated direct replenishment shipments of the canisters. The dye dispensing system may be operated by stylists using control panels or Apps on mobile devices such as a laptop, tablet, smartphone or Web browser. Commands may be transmitted to the system from software operating on an online server or from the central server.

An apparatus for dye dispensing is disclosed herein. The apparatus includes a controller and a tray. The tray communicates with the controller and is configured with at least one opening. At least one canister is configured with an identifier and a dye. The dye is associated with the identifier. A reader communicates with the controller. A dispenser comprises an actuator communicating with the controller and a lever arm. The lever arm is coupled to the actuator and configured with a projection. The reader, based on the identifier, identifies a selected dye in a selected canister associated with a dye formulation. When the selected canister is aligned with a dispensing area, the dispenser applies a downward force on the selected canister and dispenses the selected dye.

A method for dye dispensing is disclosed herein. A dye dispensing apparatus is provided. The apparatus includes a controller and a tray. The tray communicates with the controller and is configured with at least one opening. At least one canister is configured with an identifier and a dye. The dye is associated with the identifier. A reader communicates with the controller. A dispenser comprises an actuator communicating with the controller and a lever arm. The lever arm is coupled to the actuator and configured with a projection. The reader, based on the identifier, identifies a selected dye in a selected canister associated with a dye formulation. The selected canister is aligned with the dispensing area. The dispenser applies a downward force on the selected canister and the selected dye is dispensed.

In some embodiments, the dye formulation identifies at least one dye and an amount of the dye. In some embodiments, the controller accesses the dye formulation from an internal database, an external database or inputs by a user. In some embodiments, the at least one canister is supported in the at least one opening. In some embodiments, the tray is configured to hold up to 50 canisters. In some embodiments, the apparatus further includes an optical sensor. The optical sensor detects the position of the at least one canister.

In some embodiments, the canister includes a valve, a nozzle and the dye. When the downward force is applied to the selected canister, the valve opens and dye is dispensed through the nozzle.

In some embodiments, the apparatus further includes a second dispenser having a second lever arm coupled to a second actuator and configured with a second projection. When the selected canister is aligned with the dispensing area, the second dispenser applies a downward force on the selected canister and dispenses the selected dye.

In some embodiments, the apparatus further includes an instrument communicating with the controller. The instrument measures a dispensed amount of the selected dye, and the dispenser stops dispensing when the dispensed amount of the selected dye equals the amount of the dye in the dye formulation for the at least one dye. In some embodiments of the method, the method further includes an instrument measuring a dispensed amount of the selected dye. The dispenser stops dispensing when the dispensed amount of the selected dye equals the amount of the dye in the dye formulation for the at least one dye. The measuring and stopping steps for each of the at least one dye is repeated until the dye formulation is complete.

In some embodiments, the aligning of the selected canister with the dispensing area is by a drive mechanism. The drive mechanism is configured to rotate the tray. In some embodiments, the apparatus further includes a shaft having an extension and the dispenser is coupled to the extension. The aligning of the selected canister with the dispensing area is by a drive mechanism. The drive mechanism is configured to rotate the shaft while the tray is stationary. In some embodiments, the apparatus further includes a track coupled to the tray having at least one cart. The cart is configured to hold at least one canister. The aligning of the selected canister with the dispensing area is by a drive mechanism. The drive mechanism is configured to translate the cart along the track.

FIG. 1 is a perspective view of a dye dispensing apparatus in accordance with some embodiments. A dye dispensing apparatus 100 has a housing 102 made from metal, plastic, composites or a combination thereof. The housing 102 may be equipped with mounting holes to allow the apparatus to be mounted on a wall, secured to a countertop, mounted on a cart or for multiple apparatuses 100 to be coupled together. A door 104 may be located in the upper area of the housing 102 or in the side wall of the housing 102 for access to the inside of the housing 102 such as for loading and unloading canisters or resolving any concerns that may arise. The door 104 may have a lock option. A panel 106 with a screen or display may be used to enter inputs for communication with the apparatus 100 or overall dispensing system, or to serve as an information center. For example, the panel 106 may display a power mode, a login function, a queue for dispensing, and system messages. The hair color or dye may be dispensed in a dispensing area 108, such as a nook, located in a lower area of the housing 102.

Figure 2:
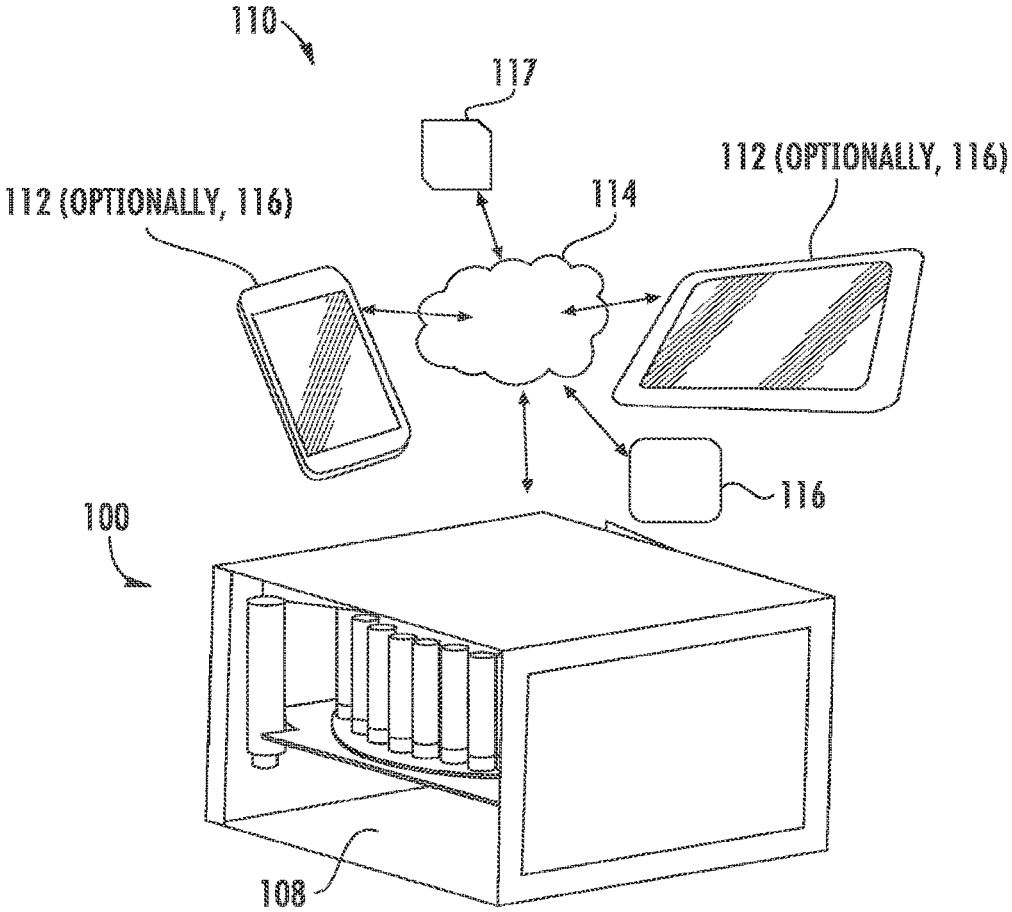
FIG. 2 is a simplified schematic diagram of a dye dispensing system environment incorporating the apparatus in accordance with some embodiments.

FIG. 2 is a simplified schematic diagram of a dye dispensing system 110 environment incorporating the apparatus 100 in accordance with some embodiments. For example, the apparatus 100 may be in communication with one or more mobile devices 112 through a network 114. The apparatus 100 includes a controller 116. The controller 116 may be contained within the housing 102 or located remotely from the apparatus 100, and in communication with the system 110 through the network 114, such as the Internet, a wide area network (WAN), a local area network (LAN), etc. Thus, the controller 116 may be a micro-control unit embedded in the apparatus 100, a separate standalone remote controller or computer, a cloud-based application, or other appropriate device or combination of devices. The controller 116 may include one or more CPU or processor boards, computer displays, touch screens and interface hardware. The communication or transmitting may be wired or wireless (or a hybrid combination thereof) and may be achieved through a WiFi system, Bluetooth® wireless technology, Ethernet, router, cellular communications, satellite communications or the like. The system may also be capable of performing as a WiFi hub. In various embodiments, the controller 116 is a laptop, computer or mobile device such as a tablet or mobile phone. In another embodiment, a user interface may be part of the controller 116 such as when the controller 116 is configured as a laptop, computer, tablet or mobile device 112, and may be used to enter inputs for communication with the apparatus 100 or system 110, or as an information center.

A dye formulation identifies at least one dye and an amount of the dye. This may be the recipe to create the hair coloring compositions for the coloring service to be performed on a client. The dye formulation may be comprised of data 117 from an internal database, an external database or input from a user.

Through the network 114, requests, commands, responses and data may be transmitted. The apparatus 100 and system 110 may support the Dynamic Host Configuration Protocol (DHCP) assignment of internal IP addresses and may initiate communications over the network 114 in response to inputs. The network 114 may utilize Ethernet and Internet protocols such as TCP/IP, UDP, HTTP or HTTPS and data formats such as HTML, JSON or XML for these transactions. In various embodiments, these communications may include user interface interactions, periodic apparatus 100 timeouts, a system 110 event such as the canister being inserted or removed, or the completion of the dispensing sequence. Communications between the apparatus 100 and the controller 116 may be via a direct or independent access channel through the network 114. In the event that the primary network connectivity becomes unavailable, a backup system may be used, that is capable of reporting GPS coordinates and supporting operating communications.

In another embodiment, multiple dye dispensing systems 110 located at one site, such as a salon, or at multiple sites, may be linked together through the network 114. There may be one central controller 116 or server connecting each dispensing apparatus 100, and acting as a hub to collect data and distribute commands to the multiple dye dispensing systems 110. The central controller 116 may receive and transmit data, information or commands. Providing a network 114 in this manner enables high quality customer service and color formulation analytics.

Figure 3:
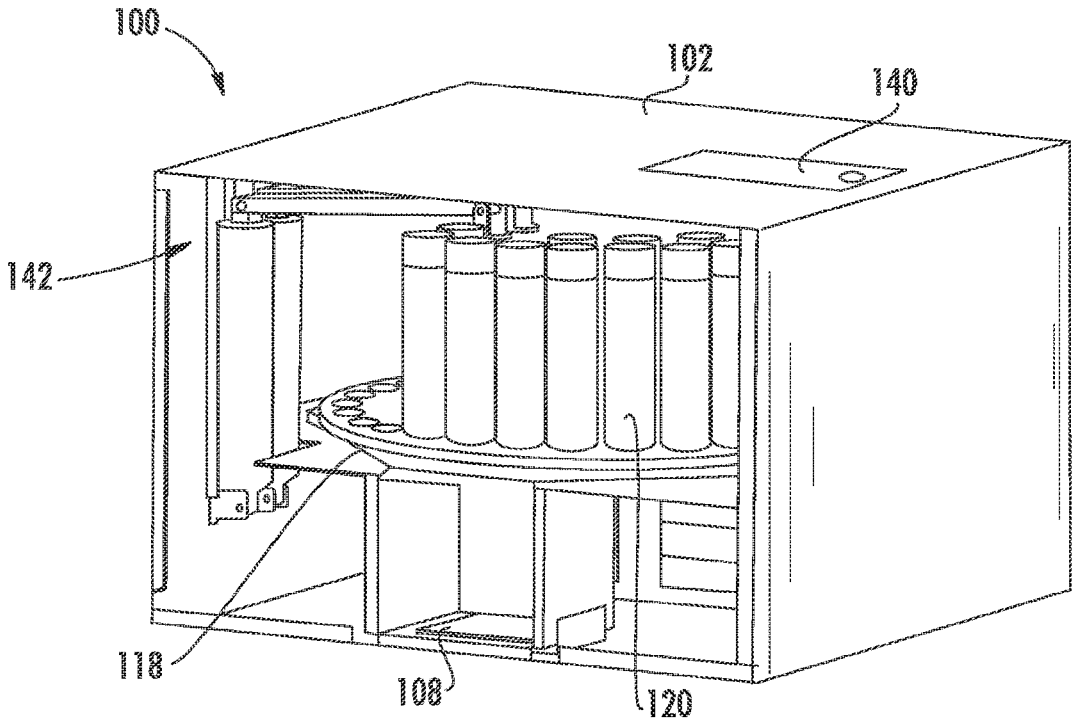
FIG. 3 is a perspective view of a portion of an interior of the dye dispensing apparatus shown in FIG. 1 in accordance with some embodiments.
Figure 4A:
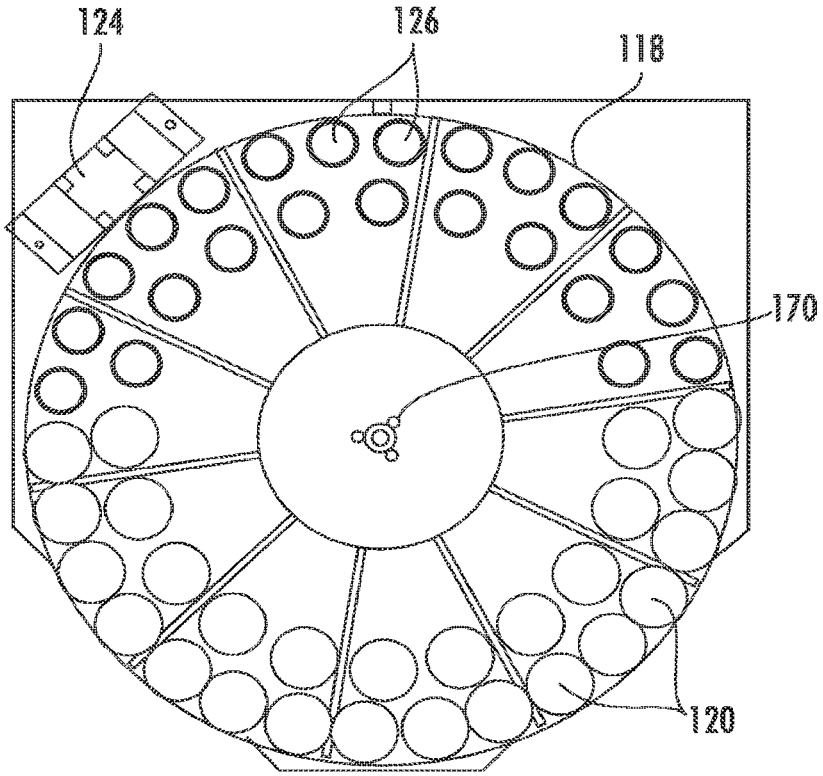
FIG. 4A shows a top view of a portion of the apparatus shown in FIG. 1 in accordance with some embodiments.
Figure 4B:
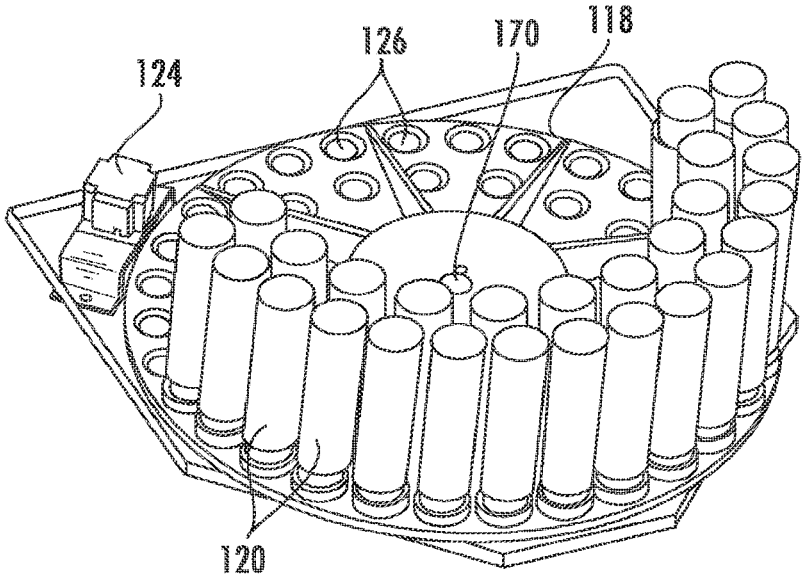
FIG. 4B shows a perspective view of the portion of the apparatus shown in FIG. 4A in accordance with some embodiments.

FIG. 3 is a perspective view of a portion of an interior of the dye dispensing apparatus 100 shown in FIG. 1 in accordance with some embodiments. FIG. 4A shows a top view of a portion of the apparatus 100 shown in FIG. 1 in accordance with some embodiments, and FIG. 4B shows a perspective view of the portion of the apparatus 100 shown in FIG. 4A in accordance with some embodiments. A tray 118 within the housing 102 may be coupled to the housing 102 and is configured to hold at least one canister 120. A bearing 170 may be coupled to the tray 118, enabling the tray 118 to rotate. The tray 118 may have any shape such as a round, carousel configuration and may be operated by a drive mechanism 124 such as a motor. The tray 118 communicates with the controller 116. In other embodiments, the tray 118 is fixed. The tray 118 is configured with at least one opening 126.

In some embodiments, there may be multiple rows of openings 126, such as two concentric rows shown in FIGS. 4A-4B. For example, the tray 118 may contain up to 50 openings 126 arranged in two rows, having an inner row with 20 openings 126 and an outer row with 30 openings 126. In other embodiments, the tray 118 may be square-shaped with 40 openings 126 arranged in four rows. In yet another embodiment, the tray 118 may be octagonal-shaped with 40 openings 126 arranged in clusters. The shape of the tray 118 and the arrangement of the openings 126 is customizable depending on the application. The ability to change the size, shape and number of openings enables the apparatus 100 to be reduced in overall size to accommodate space constraints in the salon. Moreover, the overall size of the apparatus 100 can be reduced if the particular application requires a small number of canisters 120. For example, the salon may offer a limited amount of color formulations thus only needing 10 canisters 120 instead of up to 50 canisters 120.

Figure 5A:
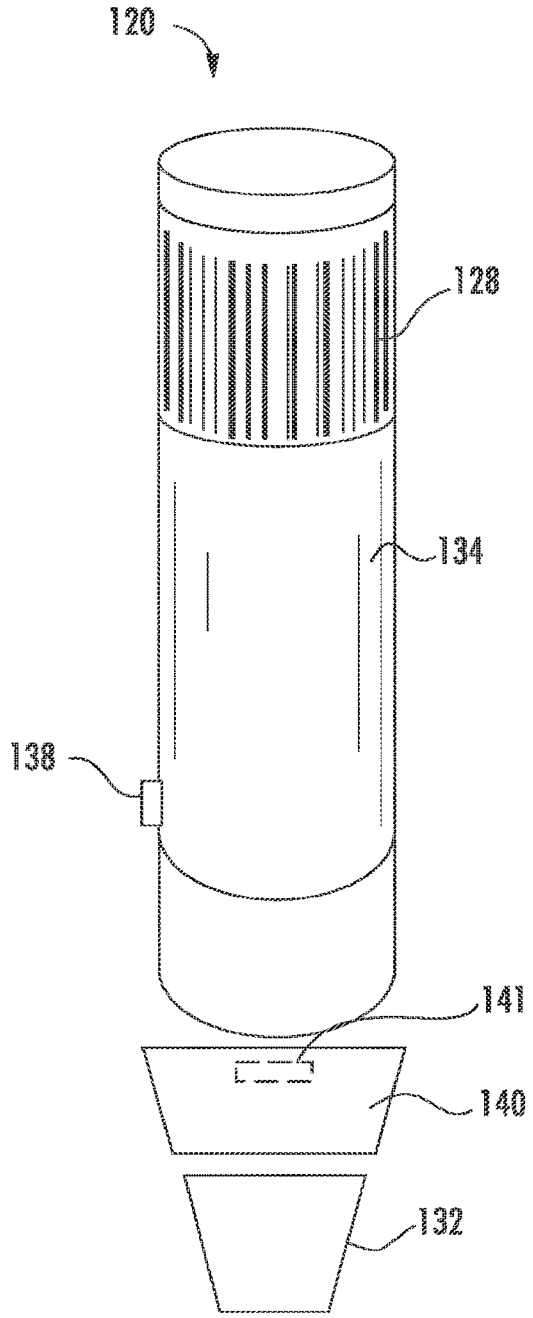
FIG. 5A is a perspective view of a canister for use in the dye dispensing apparatus shown in FIG. 1 in accordance with some embodiments.
Figure 5B:
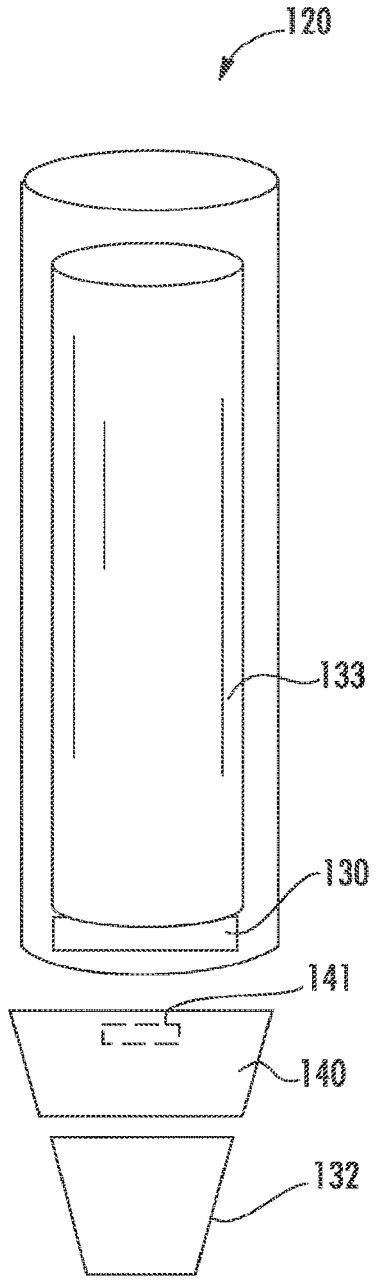
FIG. 5B is a simplified schematic view of a canister for use in the dye dispensing apparatus shown in FIG. 1 in accordance with some embodiments.

FIG. 5A is a perspective view of a canister 120 for use in the dye dispensing apparatus 100 shown in FIG. 1 in accordance with some embodiments and FIG. 5B is a simplified schematic view of a canister 120 for use in the dye dispensing apparatus 100 shown in FIG. 1 in accordance with some embodiments. At least one canister 120 is coupled to the at least one opening 126 of the tray 118. Each canister 120 is configured with an identifier 128, an internal valve 130, a nozzle 132, a sleeve 133 and dye 134. The sleeve 133 is configured to contain the dye 134. In one embodiment, the canister 120 is modular and interchangeable with one another. The storage capability may be, for example, up to 8.6 ounces but may also vary depending on the size of the sleeve. In practice, the dye 134 cannot be exposed to air until just before the color treatment. Therefore, the canisters 120 are airtight and may be composed of a metal such as aluminum, composite or a combination thereof.

Each canister 120 is labeled with a unique identifier 128 such as a barcode, QR code, catalog number or icon code. Identifier 128 may be scanned, read and recognized by a device such as a reader 136 or scanner. The reader 136 may be a standalone unit or part of the controller 116 and located within the housing. The reader 136 may be coupled to the side wall or top wall of the housing, on the dispenser or any location with a direct view of the canisters 120. Other technologies may be used for uniquely identifying the canisters 120 such as by RFID (radio-frequency identification) technology, NFC (near-field communication) technology or the like. In some embodiments, the identifier 128 verifies the presence of the canister 120 in the apparatus 100 and identifies the particular contents in the canister 120 such as the color of the dye 134. Other information may be included in the identifier 128 such as the product name, date the canister 120 was filled with the particular dye 134, the amount of the dye remaining in the canister 120, a lot or batch number and any other notes the manufacturer may wish to include.

The reader 136 communicates with the controller 116. The reader 136 is configured to scan, read and recognize the identifier 128 labeled on the canister 120 and communicates the information to the controller 116. The controller 116 may recognize the information embedded in the identifier 128 such as product name, quantity remaining in the canister 120 and lot or batch number. In another embodiment, there may be two or more readers 136 designed to identify the canister 120 located in particular areas of the tray 118. For example, one reader 136 may identify the canisters 120 in an inner row of the tray 118 while another reader 136 identifies the canisters 120 in the outer row of the tray 118.

Figure 6A:
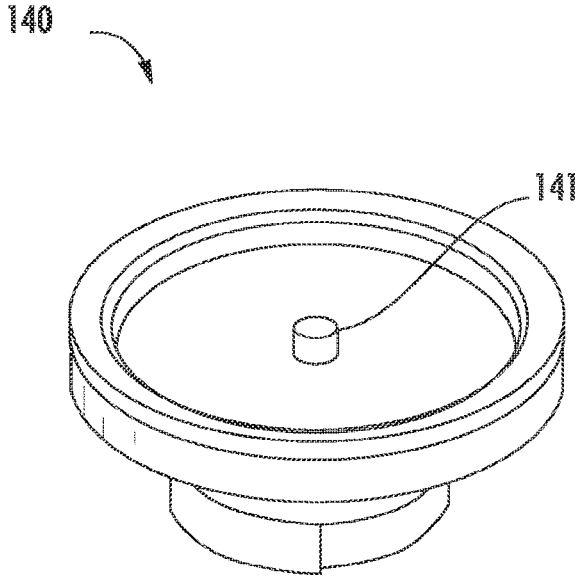
FIGS. 6A and 6B show a perspective view and a side view of the coupler for use in the apparatus shown in FIG. 1 in accordance with some embodiments.
Figure 6B:
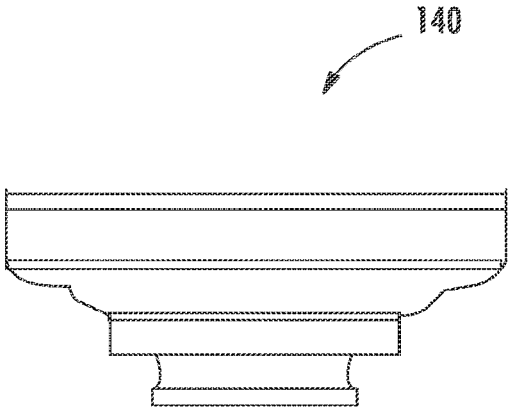

The canister 120 may be recyclable, refillable and reusable in the system 110 and is configured to be pressurized by a gas. The canister 120 may include a port 138 for injecting the gas. For example, the canister 120 may be a nitrogen pressurized canister 120. The gas and dye 134 are separated within the canister by an internal sleeve that enables the dye 134 to move uniformly downward towards an internal valve 130 when external force or pressure is exerted on the canister 120. FIGS. 6A and 6B show a perspective view and a side view of a coupler 140 for use in the apparatus shown in FIG. 1 in accordance with some embodiments. The canister 120 couples to the coupler 140 at the bottom end of the canister 120 where the dye 134 is dispensed. In some embodiments, the coupler 140 may be integral to openings 126 in the tray 118, integral to the canister 120 or a separate component. The coupler 140 supports the canister 120 in the opening 126. For example, the valve 130 is located on the bottom end of the canister 120. When a force is applied on the top of the canister 120, the valve 130 is pushed against a protrusion 141 on the coupler 140, thus opening the valve 130 and allowing and dye 134 to be dispensed through the nozzle 132. The internal valve 130 enables the canister 120 to dispense approximately all of the contents within, such as the dye 134, through the nozzle 132 via the apparatus 100. In another embodiment, the canister 120 utilizes a gravity-feed system in which gravity is used to move the dye 134 downward through the canister 120.

Figure 6C:
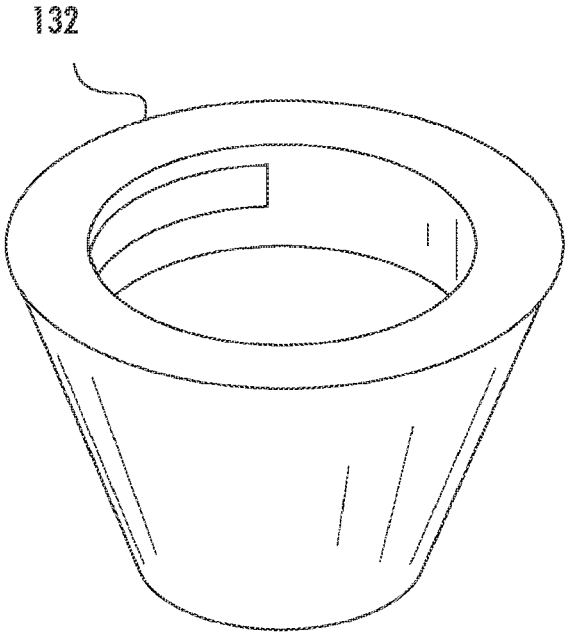
FIG. 6C is a perspective view of a nozzle for use in the dye dispensing apparatus shown in FIG. 1 in accordance with some embodiments.

FIG. 6C is a perspective view of a nozzle 132 for use in the dye dispensing apparatus 100 shown in FIG. 1 in accordance with some embodiments. The nozzle 132 may be made from plastic, metal, composite or the like and coupled to the coupler 140 or the sleeve 133. In this way, contamination is prevented because each canister 120 has its own nozzle 132. Thus, only the dye 134 from the particular canister 120 flows through the nozzle 132 as opposed to many different dyes 134 flowing through the same nozzle 132.

Figure 7A:
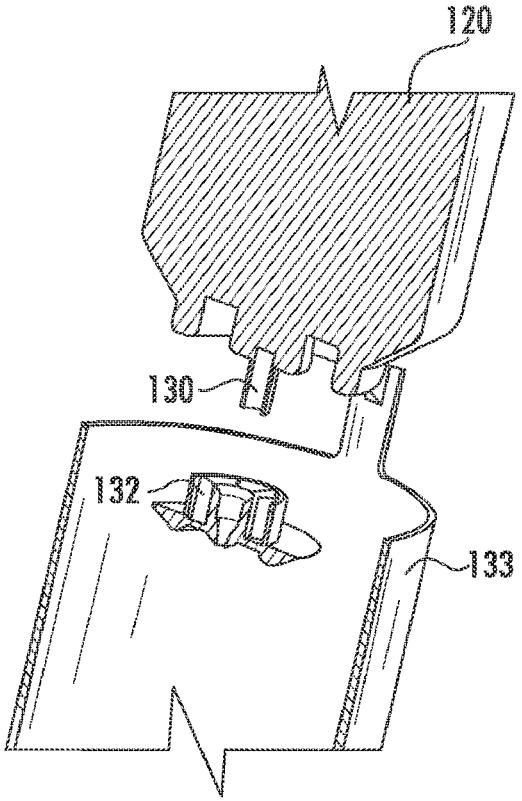
FIGS. 7A and 7B show cross sectional views of the canister for use in the dye dispensing apparatus shown in FIG. 1 in accordance with some embodiments.
Figure 7B:
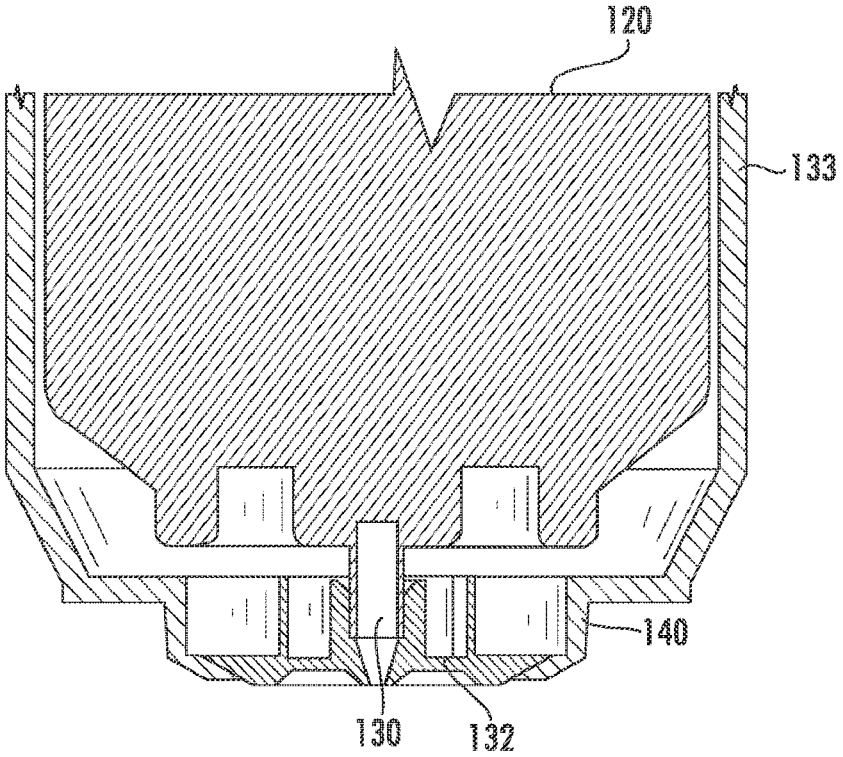

FIGS. 7A and 7B show cross sectional views of the canister 140 for use in the dye dispensing apparatus 100 shown in FIG. 1 in accordance with some embodiments. In some embodiments, the sleeve 133 is located external from the canister 120 and is integral with the coupler 140 thus the sleeve and coupler may be one component. The nozzle 132 fits inside of the coupler 140 and has angled walls. The dye 134 is held in the pressurized canister 120. The valve 130 protrudes from the bottom end of the canister 120. When the valve 130 is pushed, it allows the dye 134 inside of the canister 120 to flow out of the canister 120.

The nozzle 132 rests on the inside surface of the sleeve 133. The internal pressure inside of the canister 120 enables the valve 130 to be in a closed position, (e.g., no dye 134 will flow out of the canister 120). When force is applied to the top end of the canister 120 by the actuator 144, the valve 130 is depressed in a vertically upward direction (e.g., inside of the canister 120), creating an opposing force on the nozzle 132 which opens the valve 130 and releases the dye 134. As more force is applied by the actuator 144, the flow volume of the dye 134 increases.

Figure 8A:
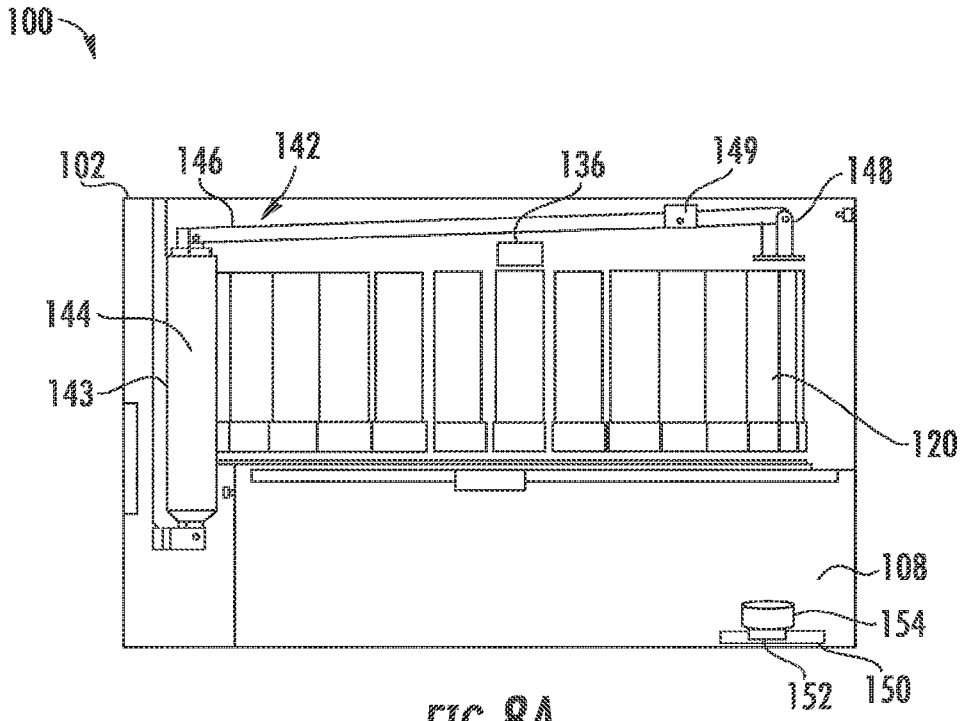
FIG. 8A shows the interior of the dye dispensing apparatus in accordance with some embodiments.
Figure 8B:
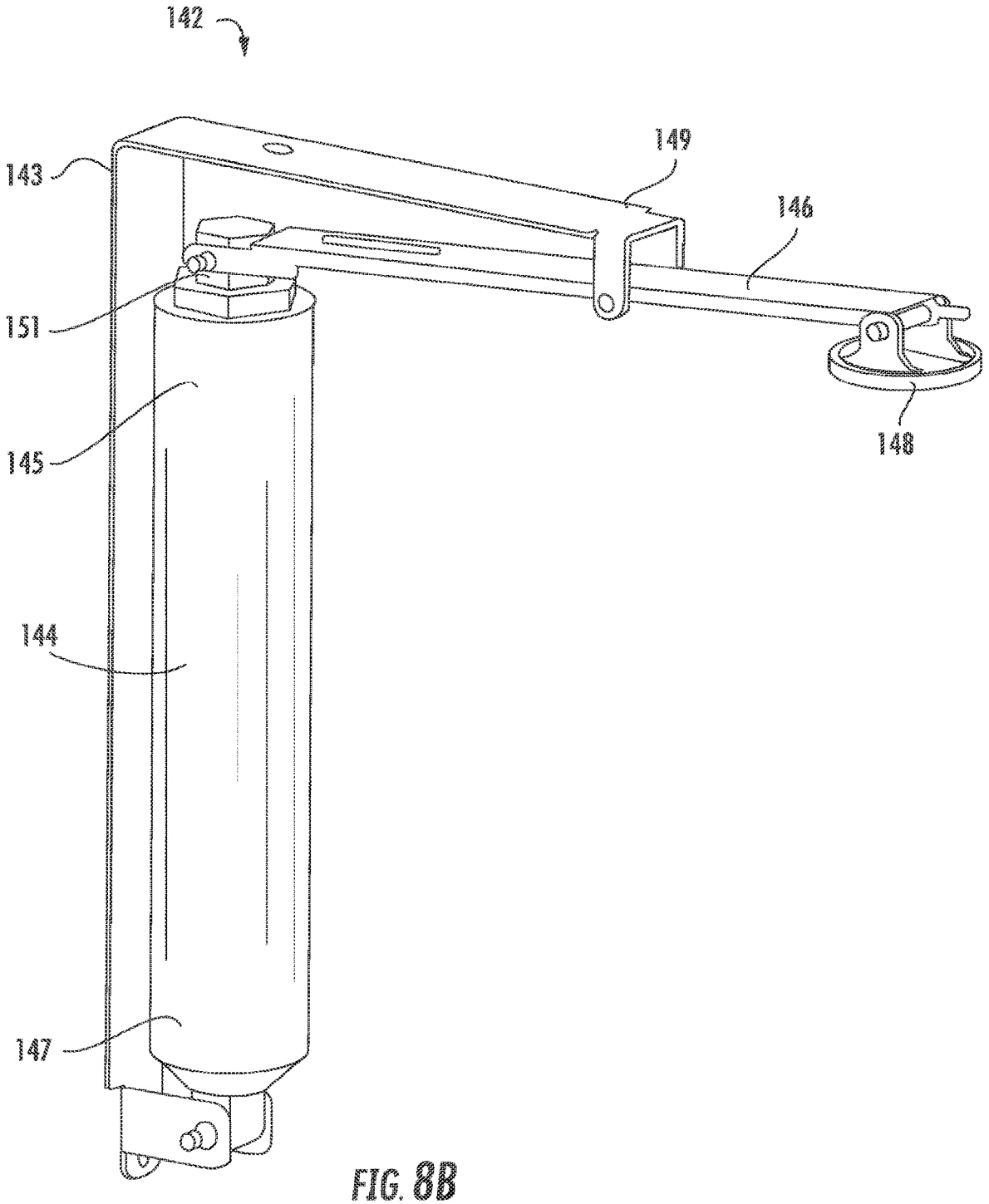
FIGS. 8B and 8C illustrate the dispenser in the dye dispensing apparatus in accordance with some embodiments.
Figure 8C:
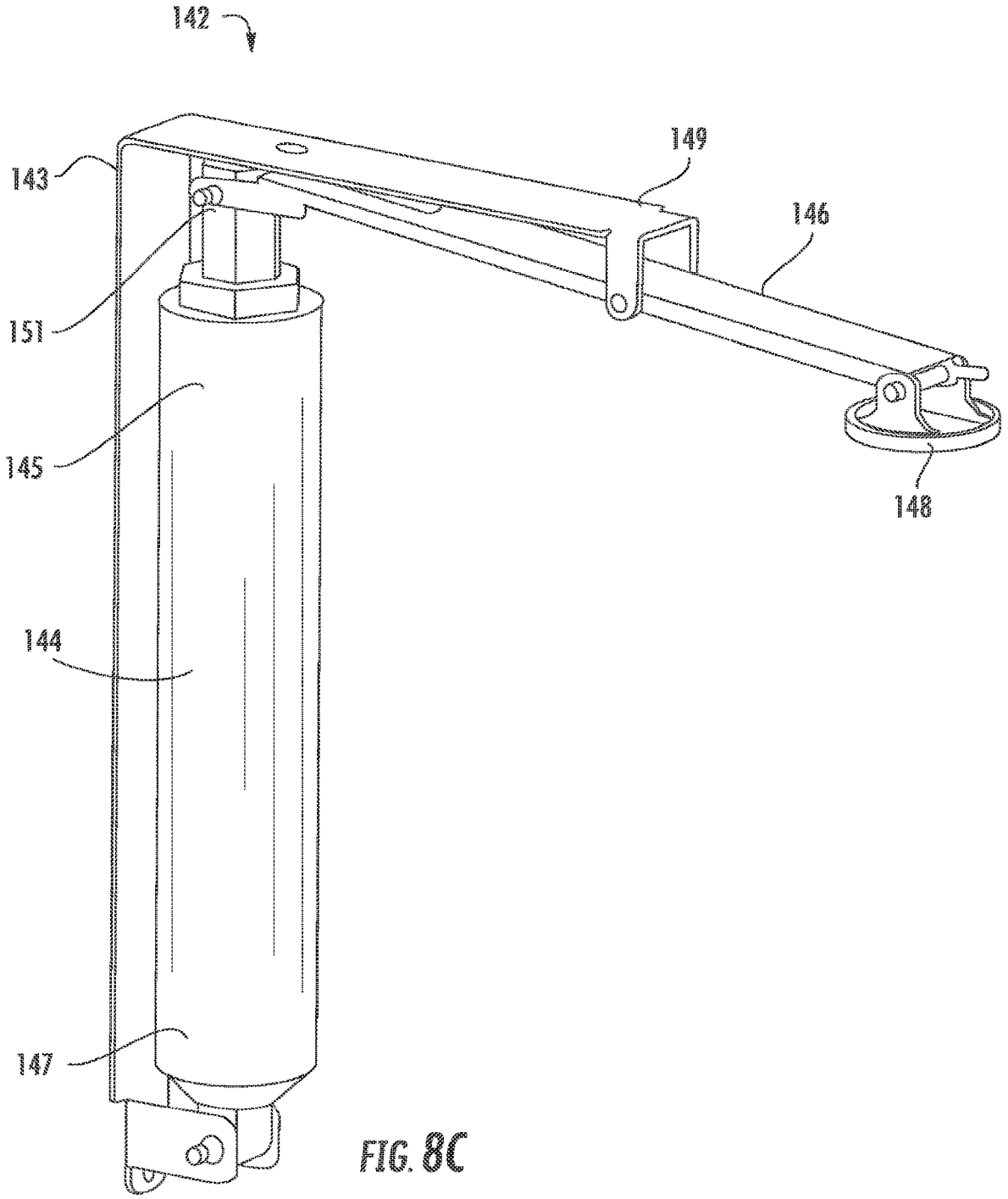

FIG. 8A shows the interior of the dye dispensing apparatus 100 in accordance with some embodiments, and FIGS. 8B and 8C illustrate a dispenser 142 in the dye dispensing apparatus 100 in accordance with some embodiments. The dispenser 142 includes at least one actuator 144. The actuator 144 can include mechanical and electrical components such as a solenoid, motor and/or piston and rod assembly; a lever arm 146; and a projection 148. The actuator 144 communicates with the controller 116. The actuator 144 is coupled to a first end of the lever arm 146, and the projection 148 is coupled to a second end of the lever arm 146. A mounting bracket 143 couples the dispenser 142 to a surface such as the housing 102. For example, in the embodiment of FIGS. 8A-8C the mounting bracket 143 is L-shaped, with one end coupled to the second end 147 of the actuator 144 and the other end coupled to the lever arm 146. The mounting bracket 143 is coupled to the lever arm 146 at a junction 149. The junction 149 serves as a support and a pivot point for the lever arm 146. When the actuator 144 is activated, an internal rod 151 of the actuator 144 is moved in an upward direction causing the lever arm 146 coupled to the first end of the actuator 144 to also move in an upward direction. At the junction 149, the lever arm moves in a downward direction, as in a teeter-totter effect, thus enabling the projection 148 to move in a downward direction and contact the surface of the canister 120 (not shown). This action applies pressure on the canister 120 and the dispensing of the dye 134 begins. FIG. 8B depicts the rod 151 of the actuator 144 non-activated and retracted. FIG. 8C shows the rod 151 of the actuator 144 during dispensing, where the rod 151 is activated and extended vertically upward.

In the embodiment of FIGS. 8B-8C, the projection 148 is configured to pivot and rotate enabling full contact with the top of the canister 120. The projection 148 is a component that extends from the end of the lever arm 146 and in some embodiments, the projection 148 may be part of the lever arm 146. The projection 148 is designed to optimally mate with the top surface of the canister 120. In some embodiments, projection 148 may have a flat or curved surface with a spring-like material such as plastic or rubber to provide flexibility and suction. In other embodiments, the projection 148 is composed of a rigid material providing resistance to the top surface of the canister 120.

When the canister 120 is aligned with a dispensing area 108, the dispenser 142 applies a downward force on the canister 120 and dispenses the dye 134. For example, the controller 116 communicates with the reader 136. The reader 136, based on the identifier 128, identifies a selected dye 134 in a selected canister 120 associated with the dye formulation. The selected canister 120 is aligned with the dispensing area 108. The controller 116 communicates with the actuator 144 which activates and positions the lever arm 146 with the projection 148 directly above the selected canister 120. The dispenser 142 applies a downward force on the selected canister 120 while the projection 148 is in direct contact with top surface of the canister 120. This opens the valve 130 of the canister 120 and causes dye 134 to escape through the nozzle 132 of the canister 120. The dye 134 is dispensed in quantities such as 0.01 grams to 140.00 grams and in any programmed ranges.

The controller 116, via the dispenser 142, starts and stops the dispensing of the dye 134 allowing for variable dispensing rates. For example, the dispensing may start slow, increase, level off and then decrease as it approaches dispensing the required amount of dye 134. The rate of dispensing may be customized depending on the amount of dye to be dispensed and the time the apparatus 100 needs to complete the dye formulation.

Figure 9A:
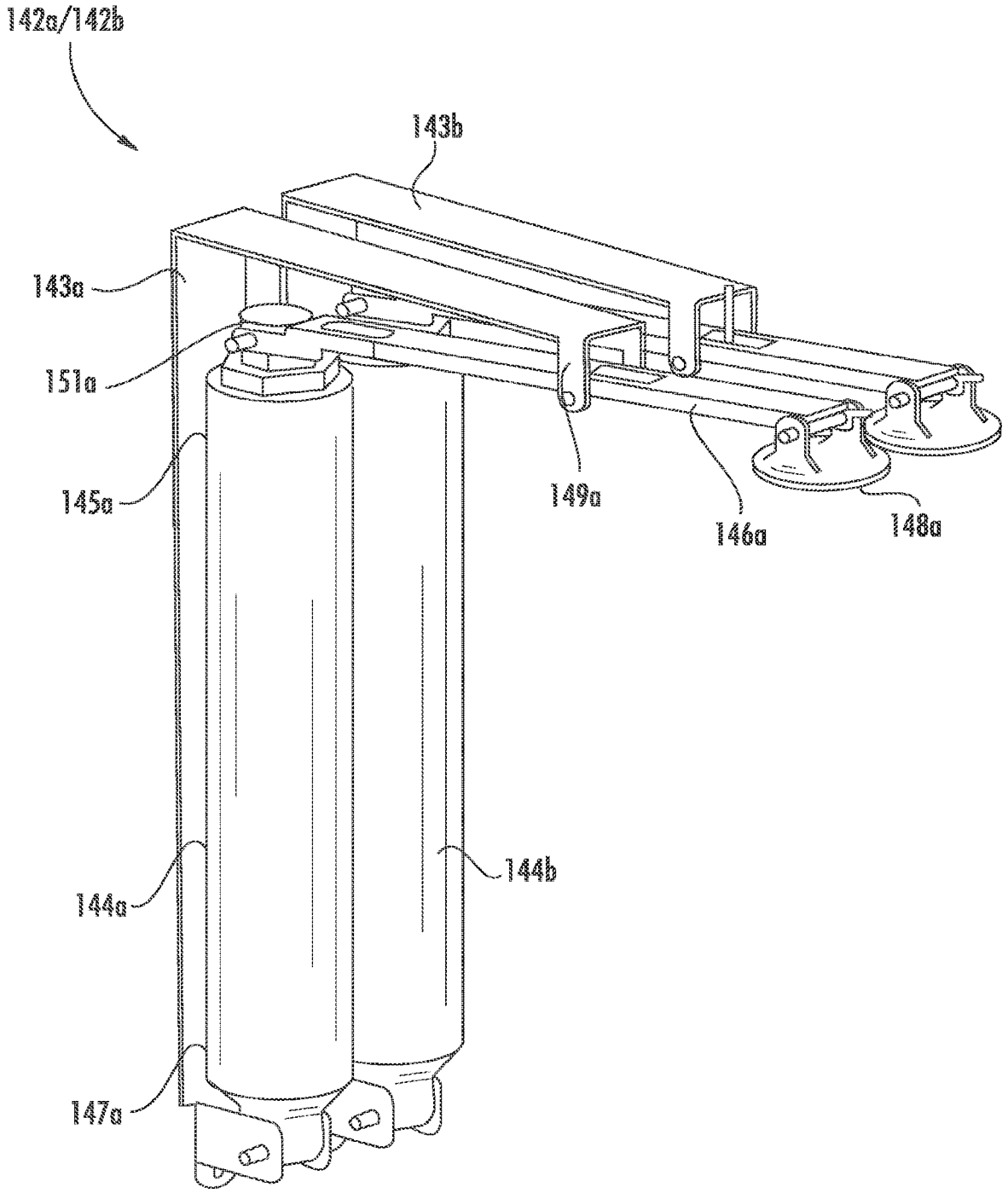
FIGS. 9A and 9B depict embodiments with a first dispenser and a second dispenser in accordance with some embodiments.
Figure 9B:
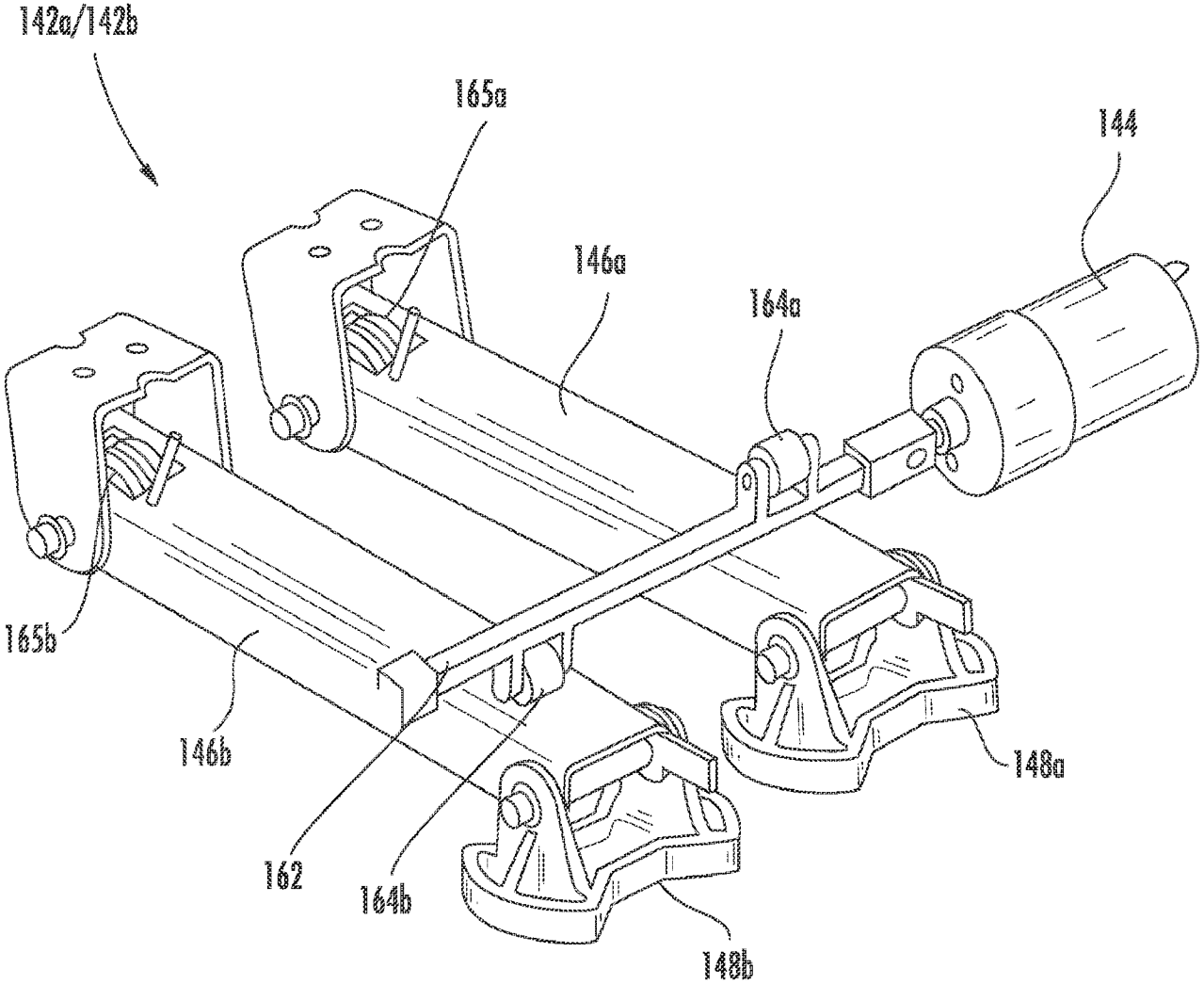

In another embodiment, there may be a second dispenser in the apparatus 100. FIGS. 9A and 9B 9A and 9B depict embodiments with a first dispenser and a second dispenser in accordance with some embodiments. The first dispenser 142*a* has a first actuator 144*a*, a first end of the first actuator 145*a*, a second end of the first actuator 147*a*, first lever arm 146*a*, a first projection 148*a* and a first junction 149*a*. The second dispenser 142*b* has similar components as the first dispenser 142*a* but for clarity, are not labelled. Mounting brackets 143*a* and 143*b* respectively, couple the dispensers 142*a* and 142*b* to the surface. In FIG. 9A, the first dispenser 142*a* and the second dispenser 142*b* each have an actuator 144*a* and 144*b* respectively but in other embodiments, may share the actuator 144. In FIG. 9B, the first dispenser 142*a* and the second dispenser 142*b* share the actuator 144.

The embodiment shown in FIG. 9A, depicts independent dispensers 142*a* and 142*b*. This may be used when the canisters 120 on the tray 118 are in a round, carousel configuration with an inner row and outer row of canisters 120. The dispensers 142*a* and 142*b* may operate one at a time, alternately or simultaneously. The operation of the first dispenser 142*a* and a second dispenser 142*b* is the same as described with reference to FIGS. 8A, 8B and 8C.

In the embodiment shown in FIG. 9B, the single actuator 144 such as a motor, activates one dispenser 142*a* or 142*b* at a time. A cam 162 with rollers 164*a* and 164*b* is coupled to the actuator 144. The rollers are 180° from one another in this embodiment. Springs 165*a* or 165*b* located on the lever arm 146*a* or 146*b* aid in holding the projection 148*a* or 148*b* off of the canisters 120. When the cam 162 rotates in a clockwise or counterclockwise direction, the roller 164*a* or 164*b* contacts the lever arm 146*a* or 146*b* and overcomes the tension of the springs 165*a* or 165*b* forcing the roller 164*a* or 164*b* to contact the lever arm 146*a* or 146*b* causing it to move in a downward direction. For example, when the rollers 164*a* or 164*b* contact the lever arm 146*a* or 146*b*, it creates a force that overcomes the spring tension, causing the lever arm 146*a* or 146*b* to move downward. Thus, the projection 148*a* or 148*b* contacts the canister 120 (not shown) and dispensing begins. To stop the dispensing, the actuator 144 causes the cam 162 to rotate, such as further in the same direction or in the reverse direction, and the pressure from the roller 164*a* or 164*b* on the lever arm 146*a* or 146*b* is released and the dispensing stops. As the cam 162 rotates, the roller 164*a* or 164*b* applies more or less pressure on the lever arm 146*a* or 146*b* and in turn, on the canister 120. This starts and stops the dispensing of the dye 134 allowing for variable dispensing rates as described herein.

The apparatus 100 further includes an instrument 152 communicating with the controller 116. The instrument 152 measures a dispensed amount of the selected dye, and the dispenser stops dispensing when the dispensed amount of the selected dye equals the amount of the dye in the dye formulation for the at least one dye. A plate 150 is located in the dispensing area 108 and vertically below the at least one opening 126 with the selected canister 120. Plate 150 may be configured with an instrument 152 to measure the contents on the plate 150. The instrument 152 may be a transducer, a scale, a gauge such as a strain gauge, or a combination thereof. A receptacle 154 is located on top of the plate 150. The receptacle 154, such as a cup or a bowl, collects the dye 134 as it is dispensed from the canister 120. The receptacle 154 may lock or snap into the plate 150 to ensure stability. The instrument 152 measures the amount of dye 134 dispensed then communicates this data to the controller 116. In one embodiment, the dispensing will not occur unless the receptacle is in the proper position. This may be indicated visually with an indicator light. The measuring and stopping steps for each of the at least one dye 134 may be repeated until the dye formulation is complete.

Figure 10:
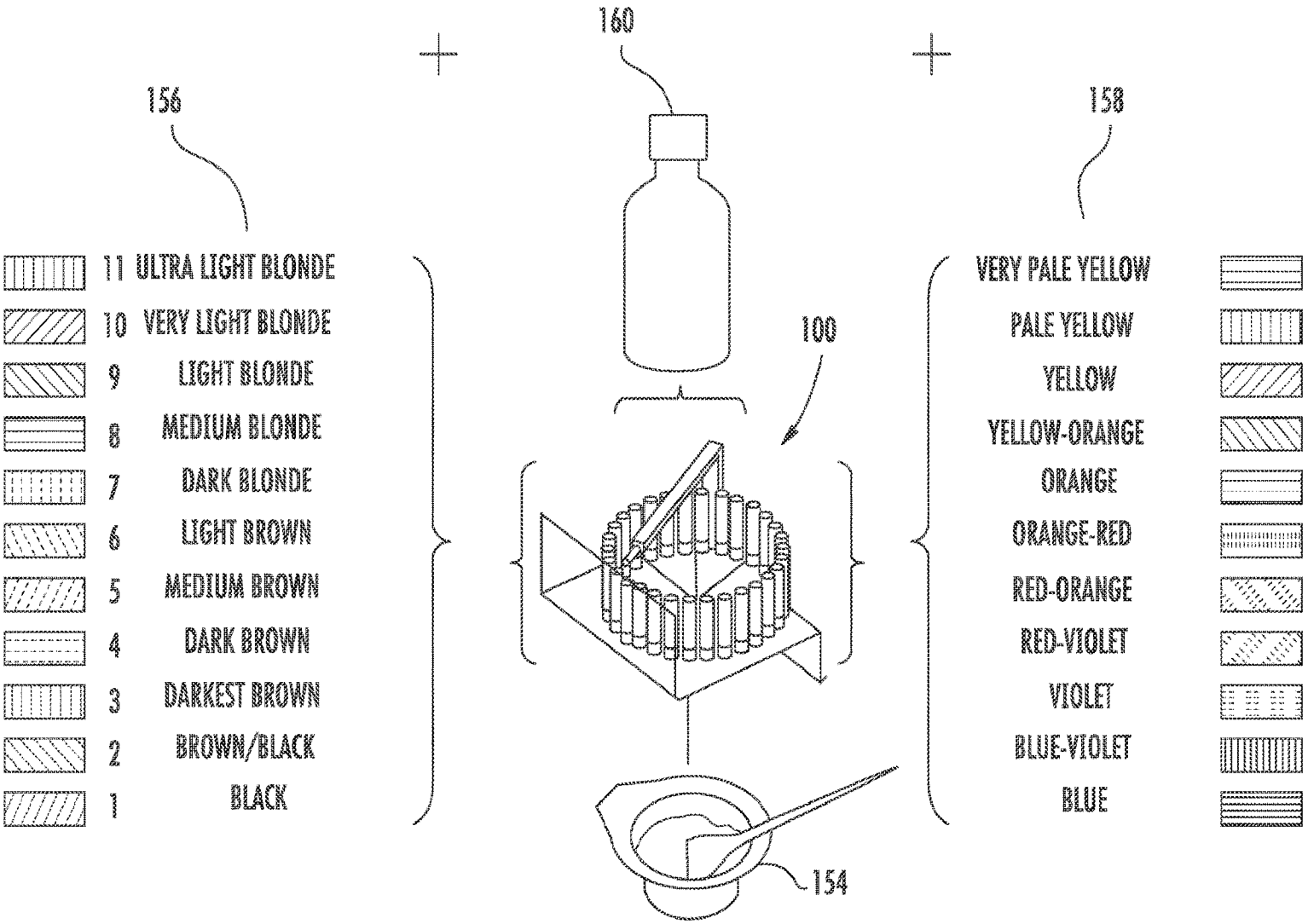
FIG. 10 illustrates a simplified schematic of components used in a method for preparing a dye formulation in accordance with some embodiments.

Typically, the salon industry relies on the knowledge and ability of the stylist to create the dye formulation, distributing the correct amount of the dye comprising the dye formulation and hand mixing. This may lead to inaccuracies and non-repeatable results. The present dye dispensing system and method which offers unique hair coloring compositions in recyclable, refillable and reusable canisters reduces waste and improves hair color services with dye formulations and dispensing control, thus retaining customers while providing new client opportunities. FIG. 10 illustrates a simplified schematic of components used in a method for preparing a dye formulation in accordance with some embodiments. In this embodiment, the components may be base levels 156 of various colors and tonal values 158 of different pigments contained in the canisters 120. These components are dispensed by the apparatus 100 according to the dye formulation and collected in the receptacle 154. A developer 160 of, for example, 5-40% may be added to or be part of the dye formulation to produce the final hair coloring composition to use on the hair of a client.

Figure 11:
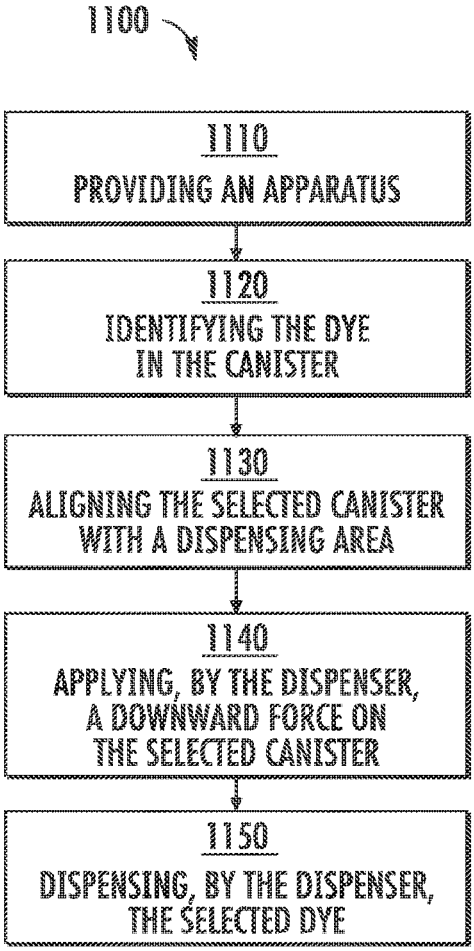
FIG. 11 is a flowchart for a method for preparing a dye formulation in accordance with some embodiments.

FIG. 11 is a flowchart for a method for preparing a dye formulation in accordance with some embodiments. The dye dispensing method 1100 includes at step 1110, providing a dye dispensing apparatus. The apparatus includes a controller and a tray. The tray communicates with the controller and is configured with at least one opening. At least one canister is configured with an identifier and a dye. The dye is associated with the identifier. A reader communicates with the controller. A dispenser comprises an actuator communicating with the controller and a lever arm. The lever arm is coupled to the actuator and configured with a projection.

At step 1120, the reader, based on the identifier, identifies a selected dye in a selected canister associated with a dye formulation. At step 1130, the selected canister is aligned with the dispensing area. At step 1140, the dispenser applies a downward force on the selected canister. At step 1150, the selected dye is dispensed.

In a non-limiting example, a client would like to change the color of her hair. To use the dye dispensing apparatus 100 and method 1100, the stylist uses a user interface such as a device 112, such as a laptop, computer, tablet or mobile phone. This may be through an App or software package or program. The stylist inputs information about the client on which the dye formulation will be applied, such as color desired, length of hair, thickness of hair and texture of hair. The controller 116 generates a request for the dye formulation based on the information. The dye formulation is comprised of data 117 from an internal database, an external database or input from a user. For example, in some embodiments, the dye formulation may be created by the controller 116 accessing a database stored in the controller 116 or stored remotely from the apparatus 100 or the user may input the dye formulation.

The dye formulation includes an identifier 128 and a specified amount of dye 134 for each of at least one dye 134. The dye formulation, like a recipe, may be comprised of at least one dye 134, including the identifier 128 and quantity of each dye 134 needed to complete the dye formulation. In this example, three different dyes 134 are required for the dye formulation. For example, 0.1 grams of dye F1, 5.05 grams of dye F2 and 4.03 grams of dye F3 comprise the dye formulation.

In one embodiment, a formulation code is generated and inputted into the panel 106 of the apparatus 100 or through the user interface, the device 112, such as a computer, laptop, tablet or mobile phone which may be the same as the controller 116. The formulation code may also be associated with the particular stylist and be used to track different information or aspects by stylist. For example, the stylist enters the formulation code on the touch screen, or panel 106, located on the apparatus 100. In another embodiment, the stylist enters the information on a personal mobile device 112. The controller 116 then transmits a signal to the reader 136 and the reader 136 reads the identifier 128 on the canisters 120 and identifies a selected dye 134 in a selected canister 120 associated with a dye formulation such as dye F1 based on the identifier 128. The controller 116 transmits a signal to a drive mechanism 124 such as a motor, and in this embodiment, the drive mechanism 124 rotates the tray 118 until the selected canister 120, dye F1, is aligned with the dispensing area 108. The actuator 144, such as the actuator, receives a signal from the controller 116, and the lever arm 146 is moved or translated until the projection 148 is directly above the selected canister 120 of dye F1. A downward force is applied on the selected canister 120 of dye F1 by the actuator 144 and through the lever arm 146 and projection 148 applying pressure on the selected canister 120 of dye F1. In one embodiment, 10-15 psi of pressure is applied for approximately 0.01 seconds to 3.0 seconds so that 0.01 grams of dye F1 is dispensed. The dye 134 is dispensed through the nozzle 132 and collected in the receptacle 154 which is positioned on the plate 150 of the dispensing area 108.

The instrument 152, such as the transducer, coupled to the plate 150 measures the dispensed amount of the selected dye 134 associated with the dye formulation and provides feedback to the controller 116, so that the controller 116 can stop the dispenser 142 from dispensing. The dispenser 142 stops the dispensing when the dispensed amount of the selected dye 134 equals the amount of the dye in the dye formulation for the at least one dye 134. This ensures the precise quantity of dye dispensed. In this example, the instrument 152 measures the dispensed dye F1 and transmits a signal to the controller 116 reporting that 0.01 grams of dye F1 was received. The controller 116 then sends a signal to the reader 136 to find the next identifier 128, dye F2, in the dye formulation. The steps in the method are repeated, as well as repeating the measuring and stopping steps for each of the at least one dye 134 until the dye formulation is completed. This includes identifying the canister 120 for dye F2, rotating the tray 118, dispensing the selected dye 134 and measuring the amount of dye dispensed. The method 1100 is then repeated to dispense the contents of dye F3. Once the contents of dye F1, dye F2 and dye F3 are dispensed, the dye formulation is complete. In some embodiments, F1, F2, F3 to F(x) may also be a developer instead of a dye. When the dye formulation is complete, the stylist is notified by an indicator light and/or a message on the user interface or panel 106.

The canisters 120 may be recyclable, refillable and reusable so that when all of the dye 134 is dispensed from the canister 120 and the canister 120 is empty, the canisters 120 may be refilled and reloaded into the dye dispensing apparatus 100. In one embodiment, the canister 120 is refilled remotely by the manufacture and then shipped to the salon. The refilled canister 120 may be loaded in the apparatus 100 through the door 104 in the housing 102.

The apparatus, system or method may send notifications in the form of an indicator light, messages on the user interface or the like, during operation. For example, the stylist may be provided with instructions on the user interface to load a particular canister 120. This may occur if the required dye 134 within the canister 120 is not available in the apparatus 100, or if a particular canister runs out of dye during dispensing, or if the dye dispensing apparatus, system or method malfunctions.

Figure 12A:
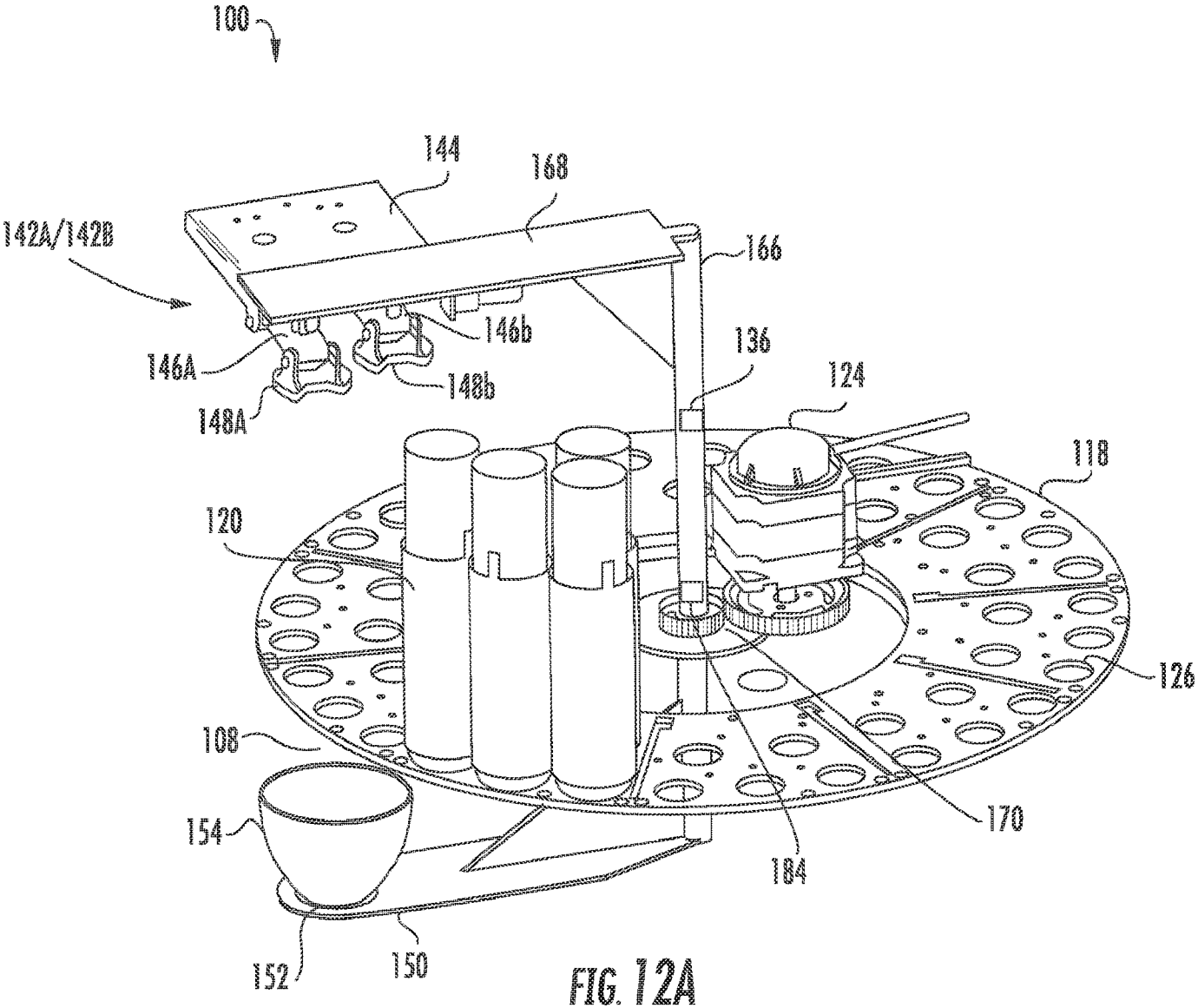
FIGS. 12A-12B illustrate perspective views of a portion of a dye dispensing apparatus in accordance with some embodiments.
Figure 12B:
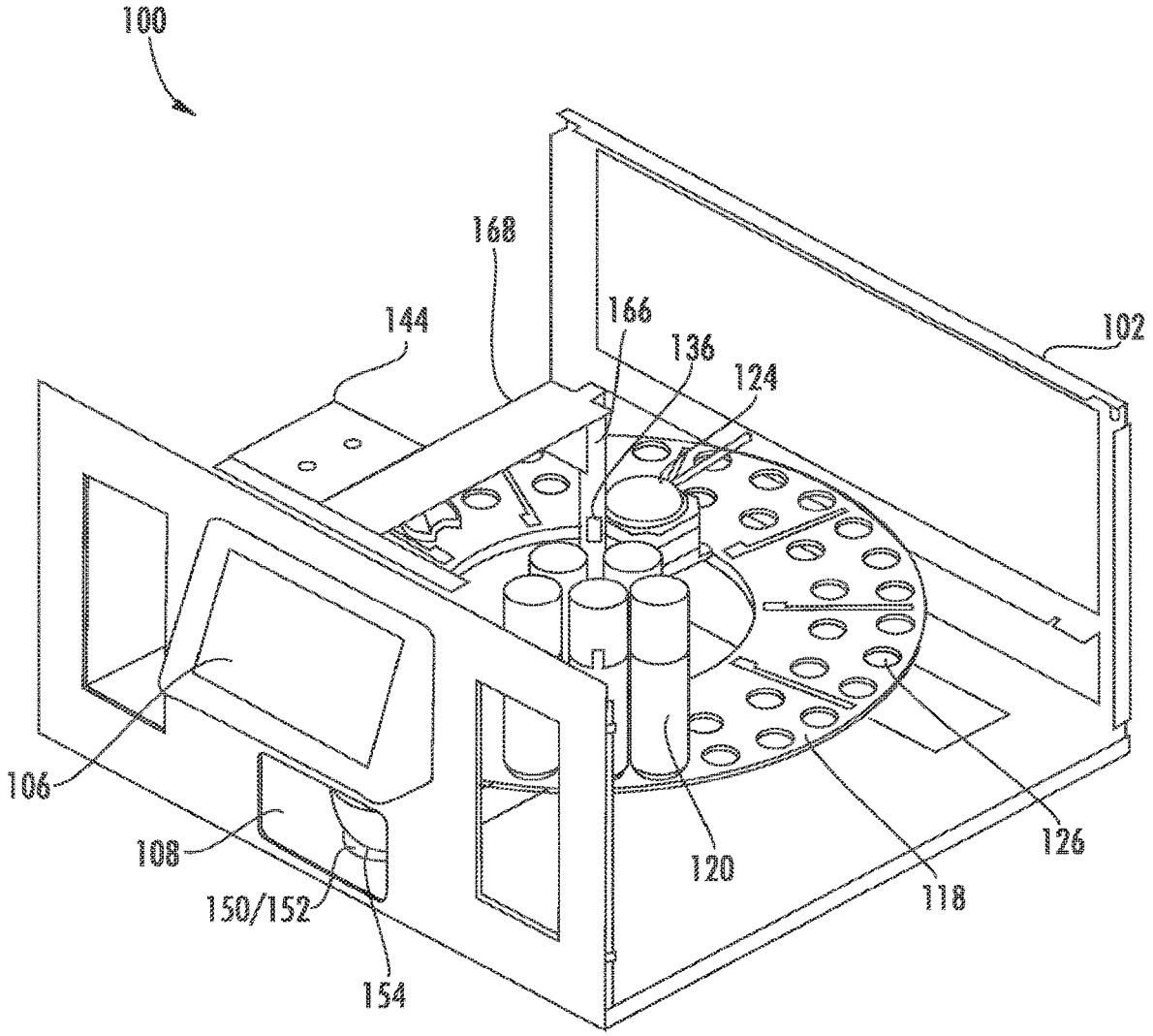

FIGS. 12A and 12B illustrate perspective views of a portion of the dye dispensing apparatus 100 in accordance with some embodiments. In this configuration, a shaft 166 has an extension 168. The shaft 166 may be coupled to the tray 118 such at the center of the tray 118. The dispenser 142 is coupled to the extension, and the plate 150 with the instrument 152 is coupled to the shaft 166. The instrument 152 may be a strain gauge. The receptacle 154 is coupled to the plate 150 in the dispensing area 108. The aligning of the selected canister 120 with the dispensing area 108 is by the drive mechanism 124. The drive mechanism 124 is configured to rotate the shaft 166 thus also rotating the extension 168, dispenser 142 and plate 150, while the tray 118 is stationary. The drive mechanism 124 may be a motor coupled to gears, and a bearing 170 may be coupled to the shaft 166 or tray 118 to enable the rotation of the shaft 166.

For example, the reader 136 may be coupled to the shaft 166, the extension 168 or the plate 150. In this way, when the shaft 166 is rotated by the drive mechanism 124, the reader 136 can identify the selected canister 120. Once the selected canister 120 is identified, the selected canister 120 is aligned with the dispensing area 108. The dispenser 142 may be a dual dispenser 142*a*, 142*b* as shown in FIG. 9B. As described previously, the controller 116 communicates with the drive mechanism 124 to align the selected canister 120 with the dispensing area 108. The controller 116 also communicates with the actuator 144 which activates and positions the lever arm 146*a*, 146*b* with the projection 148*a*, 148*b* directly above the selected canister 120. The dispenser 142*a*, 142*b* applies a downward force on the selected canister 120 while the projection 148*a*, 148*b* is in direct contact with top surface of the canister 120. This opens the valve 130 of the canister 120 and causes dye 134 to escape through the nozzle 132 of the canister 120. This may be collected in the receptacle 154. This may be repeated until all of the contents of the dye formulation have been dispensed. The nozzle 132 on the canister 120 may be cleaned of residue by a brush coupled to the shaft 166. As the shaft 166 rotates, the brush contacts the nozzle 132 removing residue.

Figure 13A:
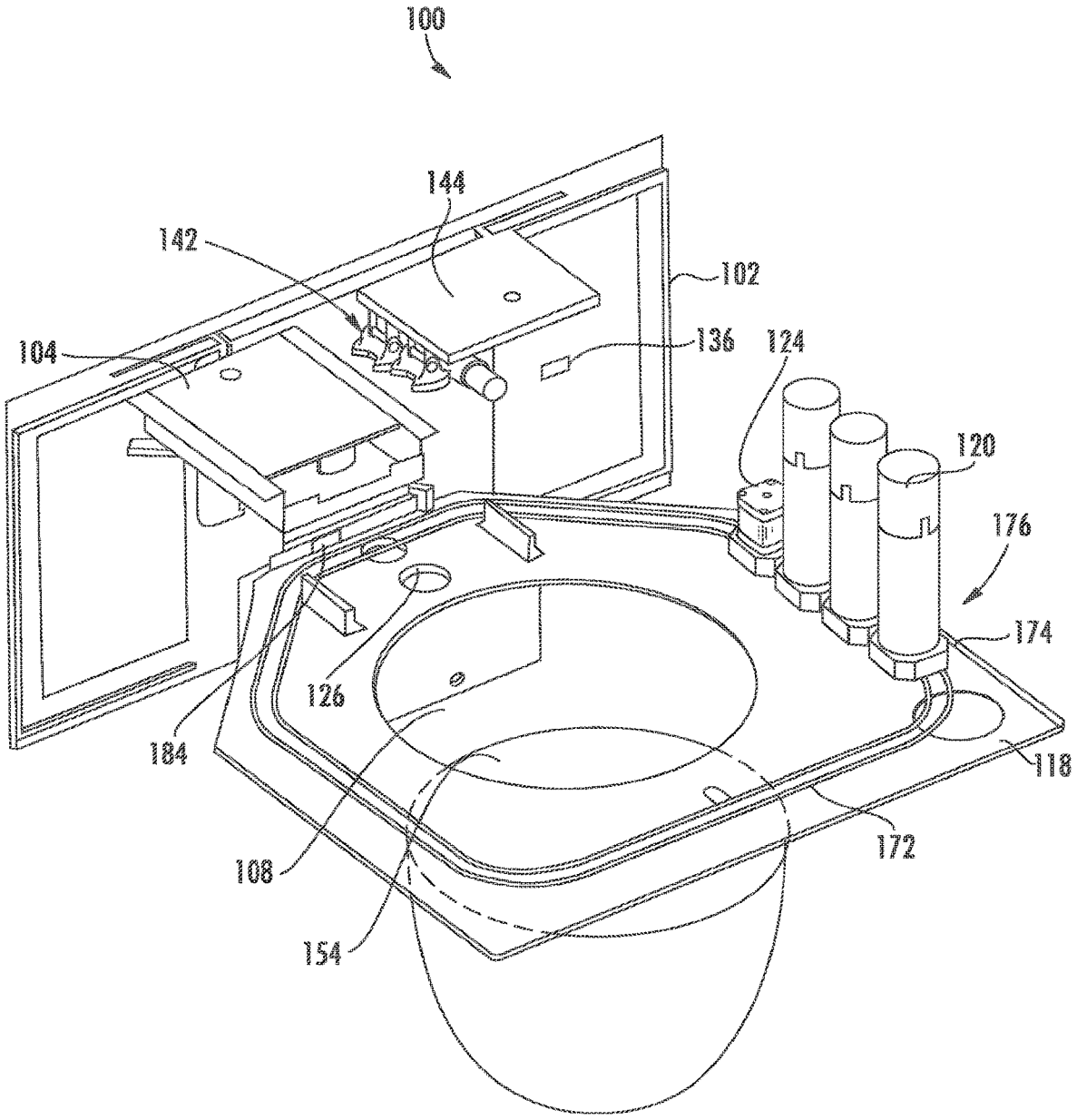
FIG. 13A illustrates a perspective view of a portion of a dye dispensing apparatus in accordance with some embodiments.

FIG. 13A illustrates a perspective view of a portion of the dye dispensing apparatus 100 in yet another configuration for moving the canisters. In this embodiment, a track 172 is coupled to the tray 118 and has at least one cart 174. There may be one or more carts 174 forming a train 176. The track 172 may have a two-rail configuration or other suitable configurations. The cart 174 is configured to hold at least one canister 120. The drive mechanism 124 may be placed in a cart 174 and configured to translate the cart 174 or train 176 riding on the track 172 by a motor. The dispenser 142 may be a single design such as shown in FIG. 8B or a dual design such as shown in FIG. 9A or 9B. The tray 118 is configured with at least one opening 126. This may serve as the dispensing area 108 with the plate 150 and receptacle 154 configured directly below opening 126.

The dispenser 142 may be coupled to the housing 102. The aligning of the selected canister 120 with the dispensing area 108 is by the drive mechanism 124 through the controller 116. For example, the reader 136 may be coupled to the housing 102, the tray 118 or the dispenser 142. In this way, when the cart 174 or train 176 is translated along the track 172 by the drive mechanism 124, the reader 136 can identify the selected canister 120. Once the selected canister 120 is identified, the selected canister 120 via the cart 174 on the track 172 is translated until it is aligned with the dispensing area 108. The dispenser 142 then contacts the selected canister 120 with the projection 148 and dispenses the selected dye 134. This may be repeated until all of the contents of the dye formulation have been dispensed. The nozzle 132 on the canister 120 may be cleaned of residue by a brush coupled to the underside of the tray 118. As the cart 174 translates along the track 172, the brush contacts the nozzle 132 removing residue.

In other embodiments, the dispenser 142 of FIG. 13A may instead be coupled to the mounting bracket 143 (as shown in FIG. 8B) and operate as described in FIG. 8B with reference to the dispenser 142. Alternatively, the dispenser 142 may be coupled to the shaft 166 as shown in FIGS. 12A and 12B and operate in the same manner as described.

Figure 13B:
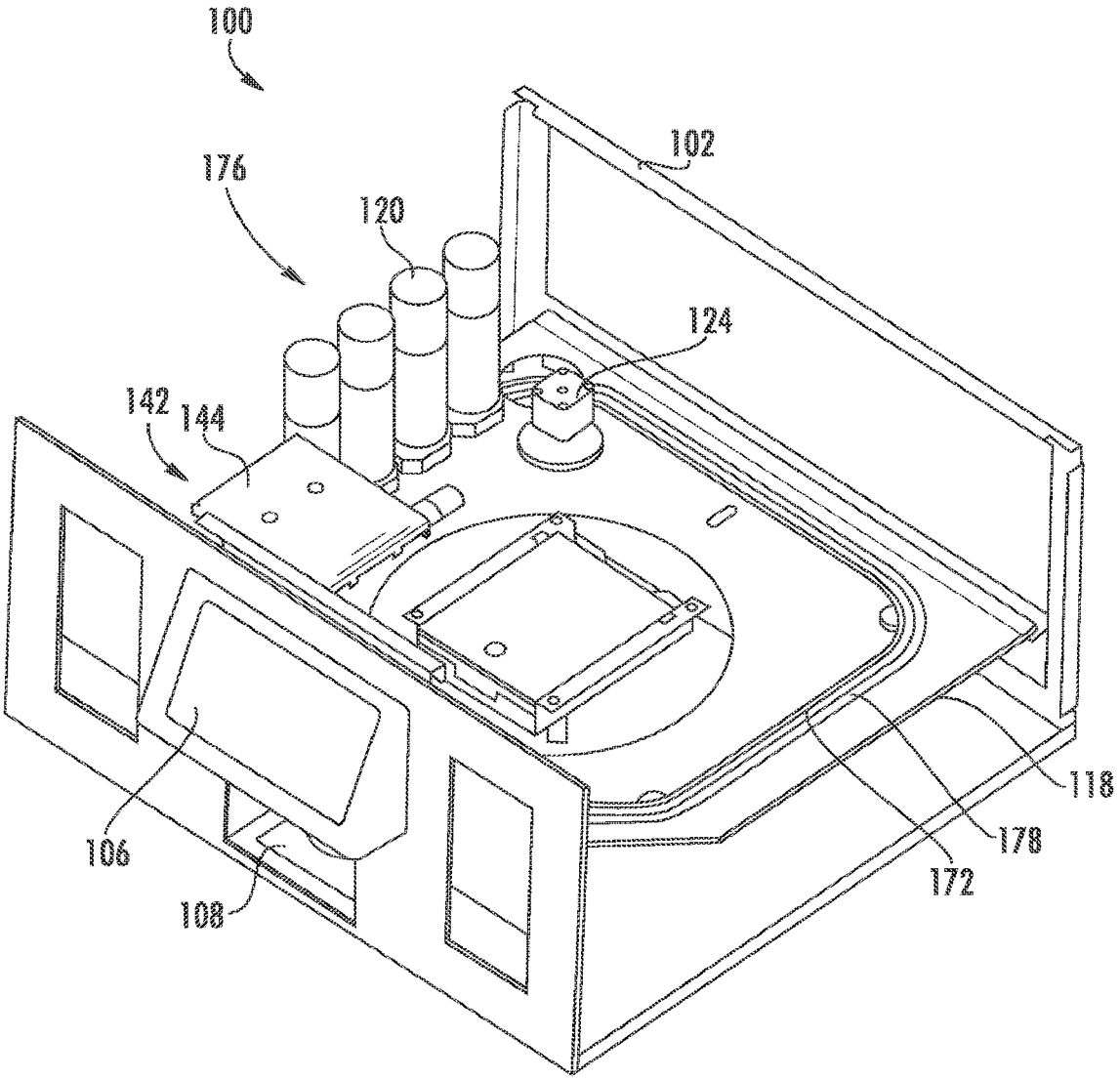
FIG. 13B illustrates a perspective view of a portion of a dye dispensing apparatus in accordance with some embodiments.

FIG. 13B illustrates a perspective view of a portion of the dye dispensing apparatus 100 in yet another configuration, similar to FIG. 13A. In this embodiment, the track 172 may have a two-rail configuration with the drive mechanism 124 which includes a motor, chain 178 and pulley system. The chain 178 is located between the two-rail track 172 and coupled to the cart 174. The cart 174 or train 176 is translated along the track 172 by the chain 178 driven system. The motor of the drive mechanism 124 may be located on the tray 118 or another suitable location.

In some embodiments, the apparatus 100 includes an optical sensor 184 to detect the position and/or presence of the at least one canister 120. The sensor 184 may be coupled to the apparatus 100 at, for example, the shaft 166 (refer to FIG. 12A), the tray 118, the housing 102 (refer to FIG. 13A), or any location with a direct view of the canisters 120, and be in communication with the reader 136 via the controller 116. In this way, as the canister 120 and sensor 184 pass one another, the sensor 184 detects the presence and position of the canister 120 creating a map for which openings 126 have canisters 120. Then, communicating with the controller 116 and/or reader 136, the reader 136 then identifies the canister 120 via the identifier 128.

Figure 14A:
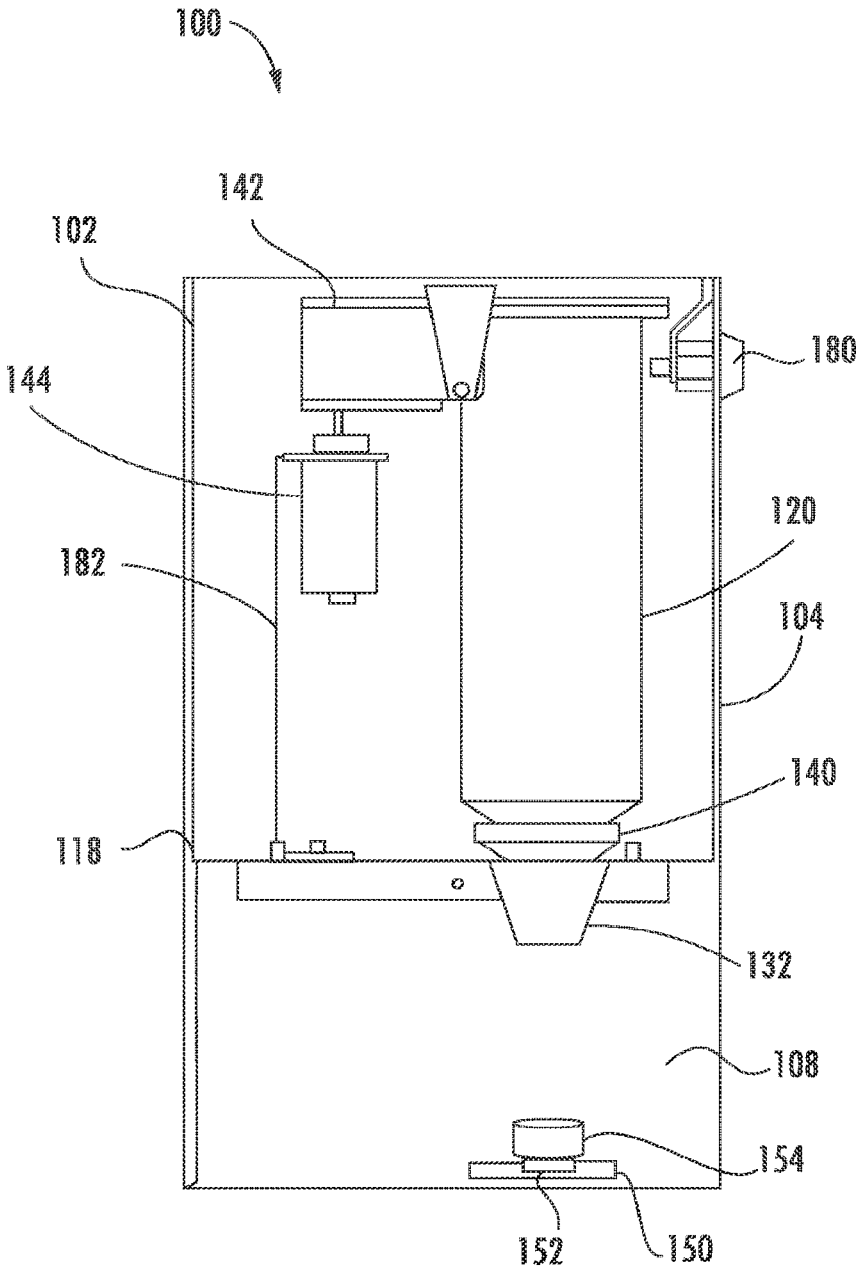
FIG. 14A illustrates a side interior view of a portion of a dye dispensing apparatus in accordance with some embodiments.

FIG. 14A illustrates a side interior view of a portion of the dye dispensing apparatus 100 in an embodiment in which the apparatus 100 is configured with only one canister 120. The canister 120 may be loaded via the door 104 which may be located on the side of the housing 102 or on top of the housing 102. A lock 180 for the door 104 may be provided for security. The canister is coupled to the nozzle 132 and fits into the coupler 140 in the opening 126 of the tray 118. The actuator 144, for example, a solenoid, is mounted to the tray 118 or the housing 102 by a strut 182. The dispenser 142 depresses the canister 120 to dispense the dye 134 within the canister 120 into the dispensing area 108 and into the receptacle 154 on the plate 150 with the instrument 152.

Figure 14B:
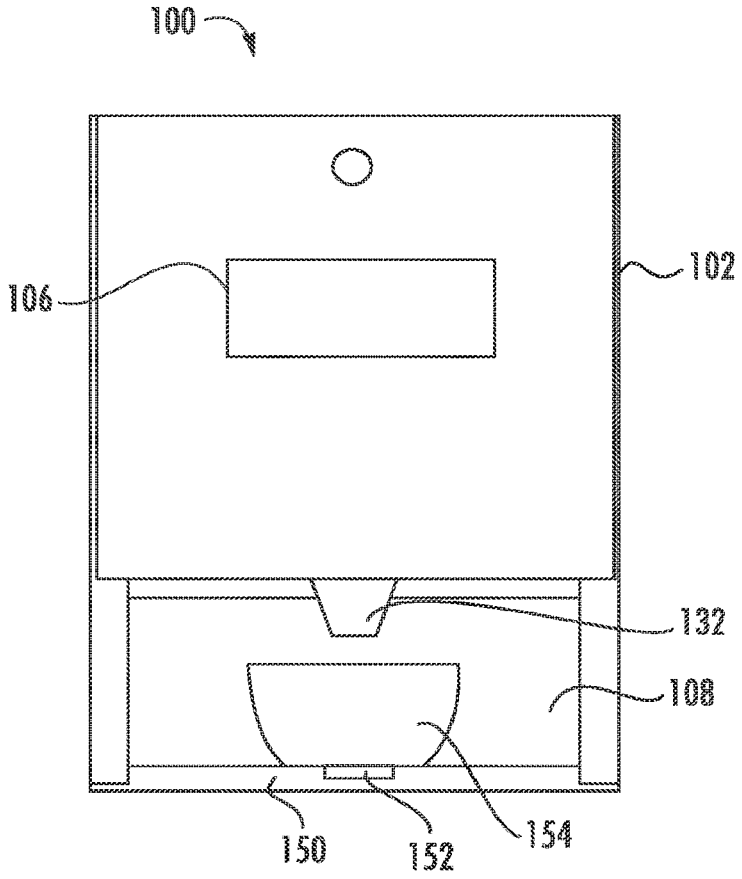
FIG. 14B is a front view of the dye dispensing apparatus in FIG. 14A in accordance with some embodiments.

FIG. 14B is a front view of the dye dispensing apparatus 100 in FIG. 14A in accordance with some embodiments. The apparatus may be operated by the panel 106 or by the mobile device 112. In one embodiment, a plurality of apparatuses 100 are mounted together, each having one canister 120, communicating and controlled by the controller 116. The dye formulation is comprised of different dyes 134, for example, F1, F2, F3 to F(x) and may be communicated to the user on the panel 106 or by the mobile device 112. After F1 is dispensed, the receptacle 154 may be moved to the next apparatus 100 where F2 is dispensed. After F2 is dispensed, the receptacle 154 may be moved to the next apparatus 100 where F3 is dispensed, and so on, until the dye formulation is complete. Alternatively, there may be only one apparatus 100 and the selected canister 120 may be loaded after each dye 134 is dispensed until the dye formulation is complete. The user may be directed via the user interface to accomplish the loading and unloading of the canisters 120 and/or moving the receptacle 154 to collect the dispensed dye 134.

The dye dispensing system or method is a comprehensive solution providing precision repeatability for custom dye formulas, packaging innovation, aid for the open stock inventory, and reordering capabilities. In some embodiments, virtually all of the dye within the canister is utilized. The salon industry generally struggles with waste during color services, inventory management expense and carrying costs, customer retention issues associated with the quality of hair color formulations and high customer acquisition costs. For hair dye, the industry generally relies on a small container such as a tube filled with dye. When performing a color service on a client, the stylist mixes the color hair by using a portion of the dye from the tube and multiple tubes are typically required. This stresses the environment with excessive packaging and waste because leftover hair color and packaging are distributed into water systems and landfills. Additionally, the unused portion of the dye in the container often goes to waste because it may not be needed for another client or is ruined due to oxygen exposure. By utilizing the canisters as opposed to the typical tubes of dye, tube, dye waste and packaging are eliminated. The typical tube of dye is approximately 1.7 ounces to 3.2 ounces. By using the canisters which in one embodiment, is configured to contain 8.6 ounces, many tubes are replaced with one recyclable, refillable and reusable canister.

The dye dispensing system 110 may be configured to track inventory and generate reports. For example, the identifier 128 of each canister 120 may be read during installation, and thereby the dye dispensing system 110 may monitor, track and reorder inventory. A self-diagnostic scan may be performed by the controller 116 or reader 136, or a combination of the two, to monitor the current operation status, location errors, warnings or failures.

The dye dispensing system 110 may automate the reordering process of the canisters 120 and salon payment processes. For example, an inventory management system may initiate replacement orders. The orders may be with an exclusive vendor that provides automatic shipping thus saving the salon owner inventory carrying costs and management labor. The inventory may be vetted against shipping data to track the information from order to delivery. The canisters 120 with the dyes 134 may be automatically invoiced and purchased electronically and automatically thus minimizing the payment effort and streamlining the processing of accounts receivable of the salon. In some embodiments, the method has a tiered marketing strategy offering direct sales to top tier salons and manufacturer representatives for lower tiers. In other embodiments, factory direct shipping of the canister reduces shipping costs and outer packaging.

Conventionally, the stylist hand-mixes the dye combinations of hair colors that are manually dispensed from tubes, containers or bottles. The industry relies on rudimentary hand-mixing tools. A poorly mixed hair color formula may result in hot spots on the scalp and inconsistent color results on the hair. In one embodiment, a cap for the receptacle 154 is provided. The cap is configured with an opening which the dispensed dye 134 may flow through when the cap is coupled to the receptacle. The cap may also be configured with a whisk driven by a motor. When the cap is coupled to the receptacle 154, the dispensed dye 134 in the receptacle 154 may be mixed by the whisk to the correct consistency, thereby mixing all of the dye 134 evenly so as not to leave any unmixed color on the surface of the receptacle 154. The whisk may be configured to be disconnected from the motor by, for example, a push and turn mechanism operating counterclockwise to the rotation of the whisk. The material of the receptacle and whisk may minimize friction and aid in cleaning hydrophobic materials. The whisk may removable and cleaned after each use.

In another embodiment, the dye dispensing system 110 is configured with a 360° image capturing capability, designed to produce an image of the client's head and shoulders. An associated application would provide an avatar of the hair and face along with a pallet of dye colors to try on, allowing the client to visualize how they would look with various colors of hair. Once selected, the target color may be translated into a formula for distribution by the dye dispensing system 110. In a further embodiment, an optical scanner may capture a three-dimensional image of the client that may be used to calculate the volume of dye required to color the hair and transmit the information to the dye dispensing system 110.

In yet another embodiment, the dye dispensing system is configured with a sensor to provide hair color feedback. Digital profiles of the client's hair before and after the hair color applications may be evaluated to access the quality of the dye formula in relation to the target color selected by the client. The hair of each client has differing characteristics that impacts the results of the hair color treatment. The feedback loop may provide data for optimizing the formula towards the target color with each use based on algorithms to translate the differences between the target and actual color into formulations that are optimized and customized per client. As data is gathered from clients, the system may be capable of learning formula adjustments thereby accurately creating formulas that achieve the target color with a smaller number of applications. This capability may also improve "first time" applications which are a common source of anxiety for stylists and clients.

In further embodiments, the apparatus 100 and method 1100 can dispense other liquids such as, for example, developer, shampoo, conditioner or additives or any combination thereof.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention. Furthermore, those of ordinary skill in the art will appreciate that the foregoing description is by way of example only, and is not intended to limit the invention. Thus, it is intended that the present subject matter covers such modifications and variations.

What is claimed is:

1. An apparatus for dispensing liquids formulations, comprising:

a tray having one or more openings;

a plurality of canisters disposed at different canister locations relative to the tray, wherein each canister comprises a liquid formulation and is associated with an identifier;

a sensor configured to detect a position of each of the plurality of canisters relative to the sensor;

a controller in communication with the sensor and configured to:

sense the position of each canister in the tray to generate a map of the canister positions relative to the tray; and dispense a selected liquid formulation from a particular canister based on the generated map; and a dispenser configured to, when the particular canister is aligned with a dispensing area:

contact an exterior of the particular canister, apply a force on the exterior of the particular canister, and dispense the selected liquid formulation.

2. The apparatus of claim 1, wherein the controller is further configured to:

identify the selected liquid formulation in the particular canister based on a hair pigment or dye formulation, align the particular canister with the dispensing area based on the generated map, and cause the selected liquid formulation to be dispensed by the dispenser into a receptacle.

3. The apparatus of claim 2, further comprising a drive mechanism configured to move the dispenser and the dispensing area to align the particular canister with the dispensing area.

4. The apparatus of claim 2, wherein the controller accesses the hair pigment or dye formulation from an internal database, an external database, a mobile or remote device, or input from a user.

5. The apparatus of claim 2, further comprising an instrument configured to measure a dispensed amount of the selected liquid formulation, wherein the dispenser stops dispensing the selected liquid formulation from the particular canister when the dispensed amount of the selected liquid formulation is substantially equal to a requested amount of the selected liquid formulation indicated in the hair pigment or dye formulation.

6. The apparatus of claim 2, further comprising at least one of:

a drive mechanism configured to move the tray to align the particular canister with the dispensing area; and a track coupled to the tray having at least one cart, the cart configured to:

hold at least one canister of the plurality of canisters, translate along the track, and align the particular canister with the dispensing area.

7. The apparatus of claim 1, wherein the generated map further comprises the canister positions relative to the one or more openings.

8. The apparatus of claim 1, wherein the map of the plurality of canisters is generated based on the detected position of the canisters relative to the sensor.

9. A method comprising:

detecting a position of each of a plurality of canisters relative to a sensor, each of the plurality of canisters:

disposed at a unique canister location relative to a tray having one or more openings, comprising a liquid formulation, and associated with an identifier;

generating a map of the one or more canisters locations relative to the tray; and dispensing a selected liquid formulation from a particular canister based on the generated map, wherein dispensing the selected liquid formulation comprises, when the particular canister is aligned with the dispensing area:

contacting an exterior of the particular canister, applying a force on the exterior of the particular canister, and dispensing the selected liquid formulation.

10. The method of claim 9, further comprising:

identifying the selected liquid formulation in the particular canister based on a hair pigment or dye formulation; and aligning the particular canister with a dispensing area based on the generated map, wherein dispensing the selected liquid formulation comprises dispensing the selected liquid formulation into a receptacle.

11. The method of claim 10, further comprising moving a dispenser and the dispensing area to align the particular canister with the dispensing area.

12. The method of claim 10, further comprising accessing the hair pigment or dye formulation from an internal database, an external database, a mobile or remote device, or input from a user.

13. The method of claim 10, further comprising:

measuring a dispensed amount of the selected liquid formulation; and stopping dispensing of the selected liquid formulation from the particular canister when the dispensed amount of the selected liquid formulation is substantially equal to a requested amount of the selected liquid formulation indicated in the hair pigment or dye formulation.

14. The method of claim 10, further comprising at least one of:

moving the tray to align the particular canister with the dispensing area; and holding at least one canister of the plurality of canisters in a tray, translating the tray along a track, and aligning the particular canister with the dispensing area.

15. The method of claim 9, wherein generating the map comprises generating the map to include the canister positions relative to the one or more openings.

16. The method of claim 9, wherein generating the map of the plurality of canisters comprises generating the map based on the detected position of the canisters relative to the sensor.

* * * * *